US011214965B2

(12) United States Patent
Gassman et al.

(10) Patent No.: US 11,214,965 B2
(45) **Date of Patent: *Jan. 4, 2022**

(54) RIDGE VENT

(71) Applicant: Owens Corning Intellectual Capital, LLC, Toledo, OH (US)

(72) Inventors: Paul Edward Gassman, Newark, OH (US); Jeffrey Wayne Smith, Lockport, IL (US); Jay D. Wagner, Holland, OH (US)

(73) Assignee: Owens Coming Intellectual Capital, LLC, Toledo, OH (US)

( * ) Notice: Subject to any disclaimer, the term of this patent is extended or adjusted under 35 U.S.C. 154(b) by 143 days.

This patent is subject to a terminal disclaimer.

(21) Appl. No.: 16/545,089

(22) Filed: Aug. 20, 2019

(65) Prior Publication Data

US 2020/0002950 A1 Jan. 2, 2020

Related U.S. Application Data

(63) Continuation of application No. 14/701,612, filed on May 1, 2015, now Pat. No. 10,415,253.

(60) Provisional application No. 61/987,211, filed on May 1, 2014.

(51) Int. Cl.
*E04D 13/17* (2006.01)

(52) U.S. Cl.
CPC ..... *E04D 13/176* (2013.01)

(58) Field of Classification Search
CPC ..... E04D 13/17; E04D 13/172; E04D 13/174; E04D 13/176
USPC ..... 454/365
See application file for complete search history.

(56) References Cited

U.S. PATENT DOCUMENTS

| | | | |
|---|---|---|---|
| 3,687,759 | A | 8/1972 | Werner et al. |
| 3,691,004 | A | 9/1972 | Werner et al. |
| 4,212,692 | A | 7/1980 | Rasen et al. |
| 4,942,699 | A | 7/1990 | Spinelli |
| 5,099,627 | A | 3/1992 | Coulton et al. |
| 5,167,579 | A | 12/1992 | Rotter |
| 5,238,450 | A | 8/1993 | Rotter |
| 5,326,318 | A | 7/1994 | Rotter |

(Continued)

FOREIGN PATENT DOCUMENTS

CA 2376583 A1 2/2003

OTHER PUBLICATIONS

Office Action from CA Application No. 2,890,488 dated Apr. 13, 2021.

(Continued)

*Primary Examiner* — Avinash A Savani
*Assistant Examiner* — Dana K Tighe
(74) *Attorney, Agent, or Firm* — Calfee, Halter & Griswold LLP

(57) ABSTRACT

A roof vent is made from convoluted filaments. The roof vent includes a center section, a first end section, and a second end section, all made from convoluted filaments. The first and second end sections each include a top layer made from convoluted filaments and a bottom layer made from convoluted filaments. The thickness of the first end section may be substantially the same as a thickness of the center section. A filter may cover the top of the center section, the tops, ends, sides, and bottoms of the first and second end sections, and a portion of a bottom of the center section, leaving a middle portion of the bottom of the center section uncovered by the filter.

20 Claims, 34 Drawing Sheets

(56) References Cited

U.S. PATENT DOCUMENTS

| | | | |
|---|---|---|---|
| 5,352,154 | A | 10/1994 | Rotter et al. |
| 5,425,672 | A | 6/1995 | Rotter |
| 5,560,157 | A | 10/1996 | Rotter |
| 5,561,953 | A | 10/1996 | Rotter |
| 5,673,521 | A | 10/1997 | Coulton et al. |
| 5,676,597 | A | 10/1997 | Bettoli et al. |
| 5,902,432 | A | 5/1999 | Coulton et al. |
| 5,960,595 | A | 10/1999 | McCorsley, III et al. |
| 5,996,289 | A | 12/1999 | Allaster |
| 6,131,353 | A | 10/2000 | Egan |
| 6,145,255 | A | 11/2000 | Allaster |
| 6,277,024 | B1 | 8/2001 | Coulton |
| 6,298,613 | B1 | 10/2001 | Coulton et al. |
| 6,308,472 | B1 | 10/2001 | Coulton et al. |
| 6,361,434 | B1 | 3/2002 | Brandon |
| 6,450,882 | B1 | 9/2002 | Morris et al. |
| 6,594,965 | B2 | 7/2003 | Coulton |
| 6,776,322 | B2 | 8/2004 | Villela et al. |
| 6,786,013 | B2 | 9/2004 | Coulton |
| 6,804,922 | B1 | 10/2004 | Egan |
| 6,981,916 | B2 | 1/2006 | Coulton |
| 7,066,371 | B2 | 6/2006 | Villela et al. |
| 7,182,688 | B2 | 2/2007 | Coulton |
| 7,384,331 | B2 | 6/2008 | Coulton |
| 7,393,273 | B2 | 7/2008 | Ehrman et al. |
| 7,422,520 | B2 | 9/2008 | Coulton et al. |
| 7,604,536 | B2 | 10/2009 | Coulton et al. |
| 7,607,270 | B2 | 10/2009 | Ehrman et al. |
| 7,814,715 | B2 | 10/2010 | Coulton et al. |
| 7,858,174 | B2 | 12/2010 | Ehrman et al. |
| 8,387,336 | B2 | 3/2013 | Coulton et al. |
| 8,430,983 | B2 | 4/2013 | Vermilion et al. |
| 8,596,004 | B2 | 12/2013 | Coulton et al. |
| 2004/0045242 | A1 | 3/2004 | Lake |
| 2005/0136831 | A1 | 6/2005 | Coulton |
| 2006/0040608 | A1 | 2/2006 | Coulton |
| 2006/0046084 | A1 | 3/2006 | Yang et al. |
| 2006/0154597 | A1 | 7/2006 | Coulton et al. |
| 2007/0050169 | A1 | 3/2007 | Jha et al. |
| 2007/0054612 | A1 | 3/2007 | Ehrman et al. |
| 2007/0093197 | A1 | 4/2007 | Shah |
| 2007/0117505 | A1 | 5/2007 | Wey et al. |
| 2008/0220714 | A1 | 9/2008 | Caruso et al. |
| 2009/0025316 | A1 | 1/2009 | Coulton et al. |
| 2009/0320399 | A1 | 12/2009 | Ehrman et al. |
| 2011/0189940 | A1 | 8/2011 | Kerwood-Winslow et al. |
| 2011/0265407 | A1 | 11/2011 | Bryson |
| 2012/0297711 | A1 | 11/2012 | Ehrman et al. |
| 2013/0178147 | A1 | 7/2013 | Keene |
| 2014/0179220 | A1 | 6/2014 | Railkar et al. |

OTHER PUBLICATIONS

Office Action from U.S. Appl. No. 14/701,612 dated Oct. 20, 2017.
Office Action from U.S. Appl. No. 14/701,612 dated Dec. 13, 2018.
Notice of Allowance from U.S. Appl. No. 14/701,612 dated May 7, 2019.

T
402
400
302
402
306
304
300
302
312
$T_B$
1200
308
$T_T$
302
900
310

402
400
702
704

902
900
904

T
304
402
400
302
402
400
302
312
310
1200
308

304
404
402
702
704

904
302
902
900

RIDGE VENT

RELATED APPLICATIONS

This application is a continuation of U.S. patent application Ser. No. 14/701,612, filed on May 1, 2015, which claims priority to and the benefit of U.S. Provisional Patent Application No. 61/987,211, filed May 1, 2014, the entire contents of which are incorporated by reference herein.

BACKGROUND

Buildings, such as for example residential buildings, are typically covered by sloping roof planes. The interior portion of the building located directly below the sloping roof planes forms a space called an attic. If unventilated or under-ventilated, condensation can form on the interior surfaces within the attic. The condensation can cause damage to various building components within the attic, such as for example insulation, as well as potentially causing damage to the building structure of the attic. In addition, unventilated or under-ventilated spaces are known to cause ice blockages ("ice dams") on the sloping roof planes. The ice blockages can cause water to damage portions of the various building components forming the roof and the attic.

Accordingly, it is known to ventilate attics, thereby helping to prevent the formation of condensation. Some buildings are formed with structures and mechanisms that facilitate attic ventilation. The structures and mechanisms can operate in active or passive manners. An example of a structure configured to actively facilitate attic ventilation is an attic fan. An attic fan can be positioned at one end of the attic, typically adjacent an attic gable vent, or positioned adjacent a roof vent. The attic fan is configured to exhaust air within the attic and replace the exhausted air with fresh air.

Examples of structures configured to passively facilitate attic ventilation include ridge vents and soffit vents. Ridge vents are structures positioned at the roof ridge, which is the intersection of the uppermost sloping roof planes. In some cases, the ridge vents are designed to cooperate with the soffit vents, positioned near the gutters, to allow a flow of air to enter the soffit vents, travel through a space between adjoining roof rafters to the attic, travel through the attic and exit through the ridge vents.

U.S. Pat. No. 4,962,699, which is incorporated herein by reference in its entirety, discloses a ridge vent made from randomly convoluted filaments. Prior art FIGS. 1 and 2 are taken from U.S. Pat. No. 4,962,699. U.S. Pat. No. 4,962,699 is incorporated by reference in its entirety.

FIGS. 1 and 2 illustrate a typical roof construction. The structural members of the roof may comprise a plurality of rafters 10, conventionally supported at their lower ends by the front and rear walls of the building. The upper ends of the rafters 10 meet at, and are attached to, a ridge pole 12, which extends between the end walls 14 of the building. Sub-roofing 15, typically comprising plywood panels, is secured to the rafters 10 and extends to the end walls 14. Conventional shingles 16 may be nailed to the sub-roofing 14 to finish the sloping portions of the roof in accordance with accepted construction practice. Conventional cap shingles 18 may then be employed in over lapping fashion to cover the peak of the roof, above the ridge pole 12. A vent 20 made from randomly convoluted filaments is interposed between the cap shingles 18 and the underlying, compositely formed portions of the roof.

A slot 22 is provided along the length of the peak of the roof to provide a passageway for venting air from the underlying attic area. The ends of the slot are spaced from the opposite ends of peak, as seen in FIG. 2. The vent 20 comprises a sheet material layer 24 and a matrix 26 of randomly convoluted filaments. The sheet material 24 serves several purposes. One characteristic is that the sheet material layer is permeable, to permit the free flow of air in venting the attic area of the roof. Another function of the sheet material is to provide a barrier protecting the attic area from the entry of both insects and water and/or snow.

As will be seen from FIG. 1, the sheet material layer 24 overlies the slot 22, thus providing a primary barrier for preventing entry of insects, and other foreign matter, into the attic area. It will further be seen that the sheet material layer 24 is wrapped around the side surfaces of the matrix 26 of randomly convoluted filaments. The sheet material 24 is heat bonded or laminated and/or bonded by a layer of adhesive to a bottom surface of the matrix of randomly convoluted filaments. Further, the sheet material layer 24 is also wrapped around the end surfaces of the resilient matrix 26 (See FIG. 2). There is thus provided a barrier which prevents the intrusion of insects into the matrix 26.

While the sheet material layer is permeable to air, as is necessary for its venting function, preferably, it is a barrier to liquid flow. This function is required, for example, in the event of driving rain, to prevent water from entering the attic area. The feature of wrapping the sheet material layer around the side and end edges of the resilient matrix 26 provides this water barrier function. It is further preferred that the sheet material layer 24 be non-wicking, and preferably hydrophobic. In another exemplary embodiment, the sheet material layer 24 is wicking and hydrophilic. Once the wicking and hydrophilic sheet material layer 24 is saturated, the sheet material layer becomes a barrier to liquid flow.

The several functions and characteristics of the layer 24 are preferably provided by a non-woven polyester fiber, filter fabric. In an exemplary embodiment, the sheet material layer 24 has a thickness of approximately 0.030 inch and has an equivalent opening size of 150 microns. In an exemplary embodiment, the sheet material layer 24 has a net free volume of greater than 80%, such as a net free volume of greater than or equal to 85%. A non-woven fabric may be characterized by being constituted with a liquid, acrylic binder, which not only gives it the desired non-wicking property, but enhances this characteristic by rendering it hydrophobic. The manufacture of such non-woven fabrics is a well developed art. A non-woven fabric can be made to be hydrophilic as well. The functional characteristics desired are sufficient to define and enable the acquisition, from commercial sources, of the fabric employed herein.

The matrix 26 of convoluted filaments may be nylon filaments 28. This is a thermoplastic polyamide resin which may be extruded in situ. The randomly convoluted filament matrix 26 of convoluted filaments is advantageously formed by extrusion of a melted polymer through articulated spinnerets. U.S. Pat. Nos. 3,687,759, 3,691,004 and 4,212, 692, which are incorporated herein by reference, teach methods and apparatus for so forming the matrices of convoluted filaments. U.S. Pat. Nos. 3,687,759, 3,691,004 and 4,212, 692 are incorporated herein by reference in their entirety.

FIGS. 2A-2D are taken from U.S. Pat. No. 4,212,692. At the distance D from the bottom face plate of spinneret 1, a hollow cylindrical roll or drum 2 having a base rim 3 with the profiled projections 4 around its periphery is aligned in such a manner that the four rows of filaments 5 being melt spun from the spinneret 1 are deposited on and between the projections 4 (see FIG. 2C). The deposited filaments 5 form the primary matting sheet M of convoluted filaments, which after cooling is withdrawn from the roll and travels in direction of arrow A to winding take-up or collection means (not shown). The projections 4, may assume the shape of a truncated cone, a truncated pyramid, a hemisphere, a nail or screw with a prominent head, or the like mounted in the surface of the base rim 3 of drum 2. When using a large drum 3, the profiles 4 offer upper peaks 4' falling in a slightly curved plane so that D fluctuates by a small increment over the four rows of filaments 5. For practical purposes, however, this slightly curved plane provides an approximate horizontal intersection with the vertically falling filaments. The filaments fall on top of each profiled projection and then extend in a random manner into the reentrant or valley portions between the projections in the form of overlapping and intermingled loops, at least some of these loops being directed transversely of the drum as well as longitudinally during the rotation of the drum.

FIG. 2B illustrates an especially preferred profile composed of the truncated pyramids 4. As further shown in FIG. 2C, the continuous looped filaments 5 are deposited on the flattened peaks or upper salient portions 4' of the truncated pyramids 4 and also in the valleys between truncated pyramids 4 to form the three-dimensional, waffle-shaped matting M. FIG. 2D illustrates the matting M as obtained by spinning filaments onto a profiled surface consisting of projecting hemispheres.

The described matrix 26 of convoluted filaments provides a basic function of spacing the cap shingles 18 above the underlying, peak portion of the compositely formed roof, thus providing a venting passageway for the flow of air from the attic-venting slot 22. Further, this matrix is relatively plastic, i.e., capable of deformation without fracturing. Thus the vent 20 can be nailed, or stapled, to the sub-roofing without the need of special care. That is, while it would be preferable to drive a nail into the sub-roofing so that its head is spaced therefrom a distance approximating the vent thickness, no harm is done if a nail is driven to the point that the matrix is compressed beneath the head.

The described matrix further has a resilient feature which is of particular significance. For example, when installed, the vent 20 is not readily apparent. It must, necessarily, be anticipated that workers on the roof will step on the cap shingles, so that their weight will compress the vent the portion of the matrix 26 beneath their feet. The resilient characteristic of the matrix, after this crushing pressure has been removed, will restore the matrix, substantially, to its original height, thus maintaining the desired venting flow area.

Vent material may be fabricated in indeterminate lengths. The matrix may be formed on and attached to the sheet material layer 24. The sheet material layer is then wrapped around the side edges of the matrix 26 and folded against the upper, marginal surfaces of the matrix and secured thereto by the adhesive layer, FIG. 4. The compositely formed vent material is relatively flexible and may be readily coiled in rolls.

Installation of the vent 20 involves as a first step, a section of venting material may be cut from a roll, with a length approximating, or somewhat greater than, the length of the roof peak to which it is to be applied. The vent 20 is then positioned and positively held in place by a few nails 38, to prevent accidental displacement. The cap shingles 18 are installed, by nails 40, in conventional, overlapping fashion.

SUMMARY

A roof vent is made from convoluted filaments. The roof vent includes a center section, a first end section, and a second end section, all made from convoluted filaments. The first and second end sections each include a top layer made from convoluted filaments and a bottom layer made from convoluted filaments. The thickness of the first end section may be substantially the same as a thickness of the center section. A filter may cover the top of the center section, the tops, ends, sides, and bottoms of the first and second end sections, and a portion of a bottom of the center section, leaving a middle portion of the bottom of the center section uncovered by the filter.

Various objects and advantages will become apparent to those skilled in the art from the following detailed description of the invention, when read in light of the accompanying drawings. It is to be expressly understood, however, that the drawings are for illustrative purposes and are not to be construed as defining the limits of the invention.

BRIEF DESCRIPTION OF THE DRAWINGS

Prior art FIG. 1 corresponds to FIG. 1 of U.S. Pat. No. 4,962,699;

Prior art FIG. 2 corresponds to FIG. 2 of U.S. Pat. No. 4,962,699;

Figure 1:
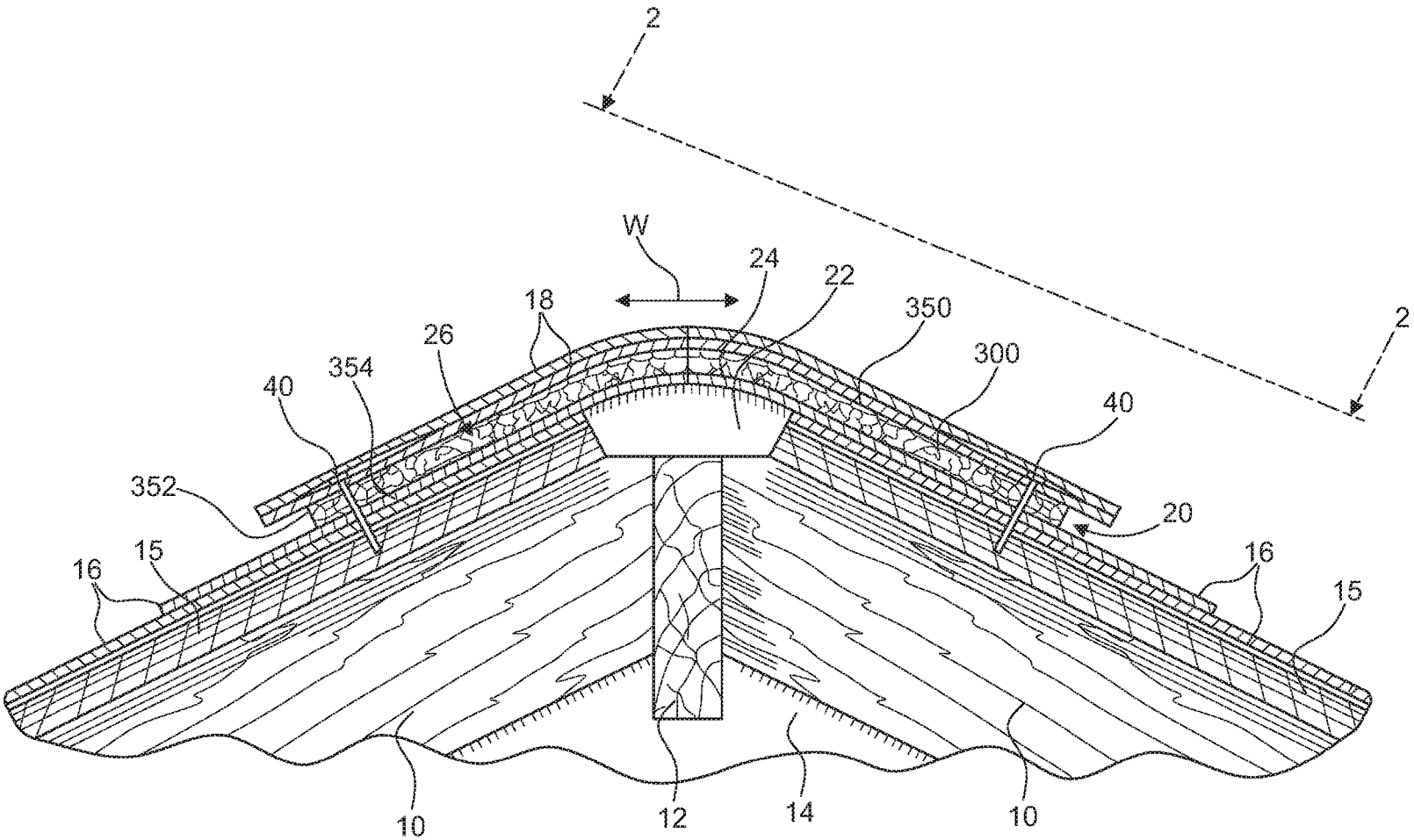
FIG. 1 (PRIOR ART)
Figure 2:
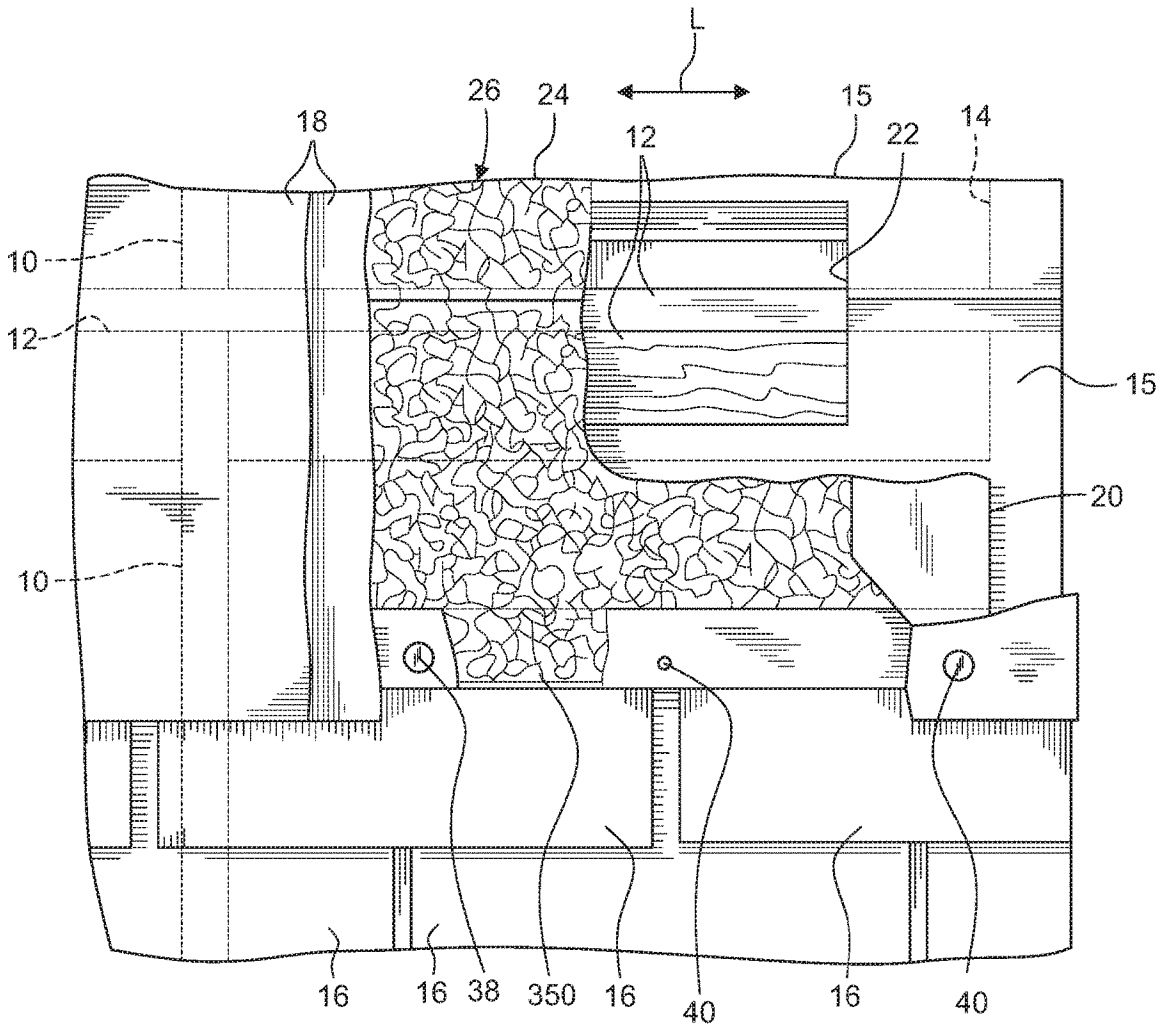
FIG. 2 (PRIOR ART)
Figure 2A:
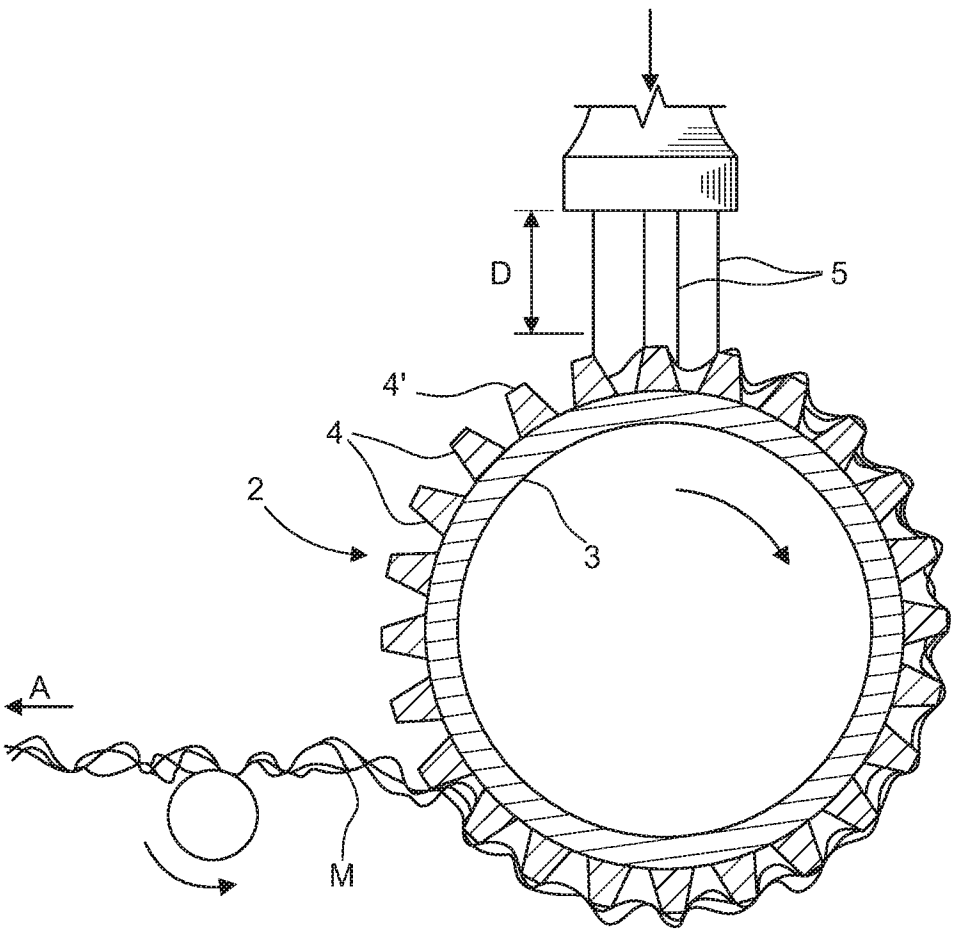
FIG. 2A (PRIOR ART)
Figure 2C:
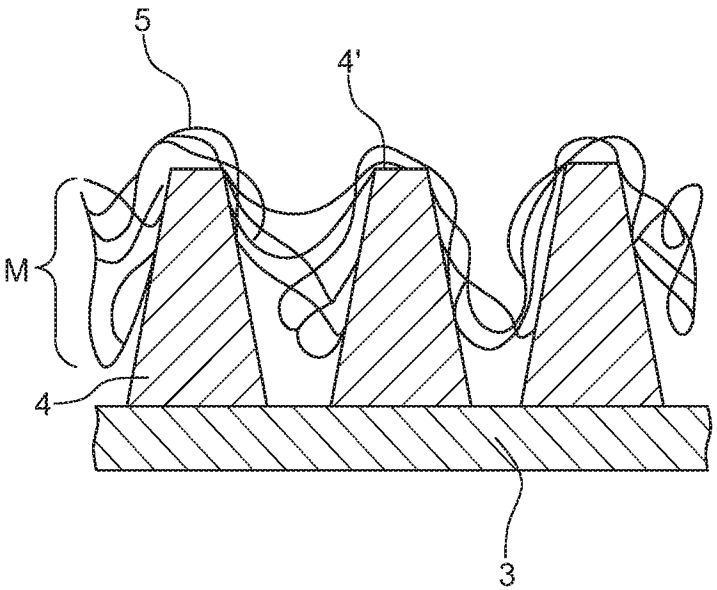
FIG. 2C (PRIOR ART)
Figure 2B:
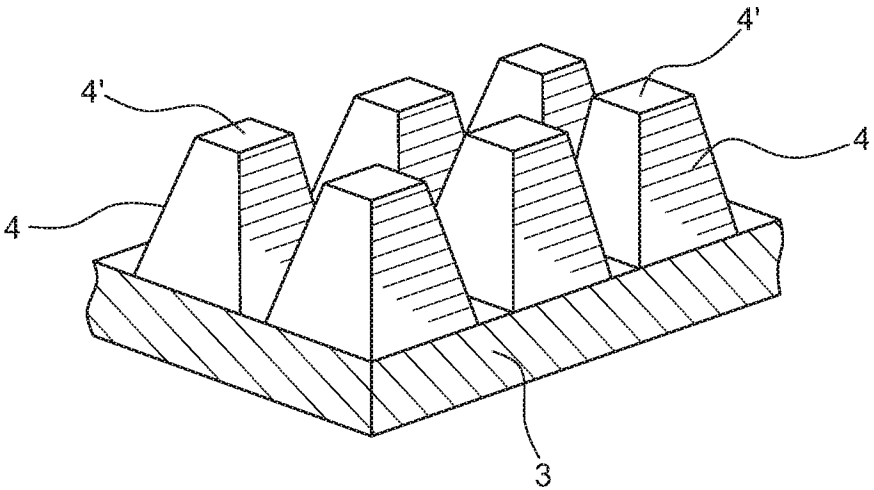
FIG. 2B (PRIOR ART)
Figure 2D:
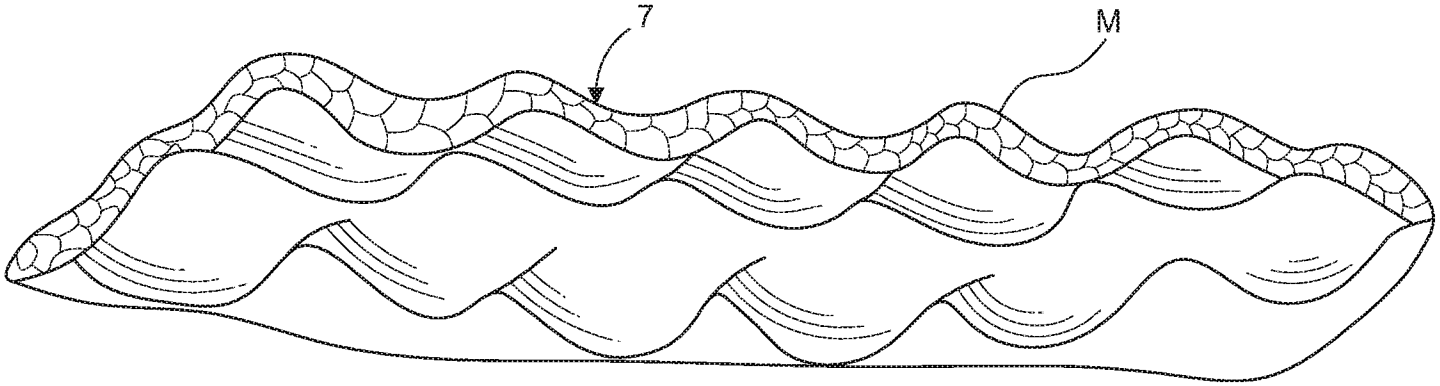
FIG. 2D (PRIOR ART)
Figure 3:
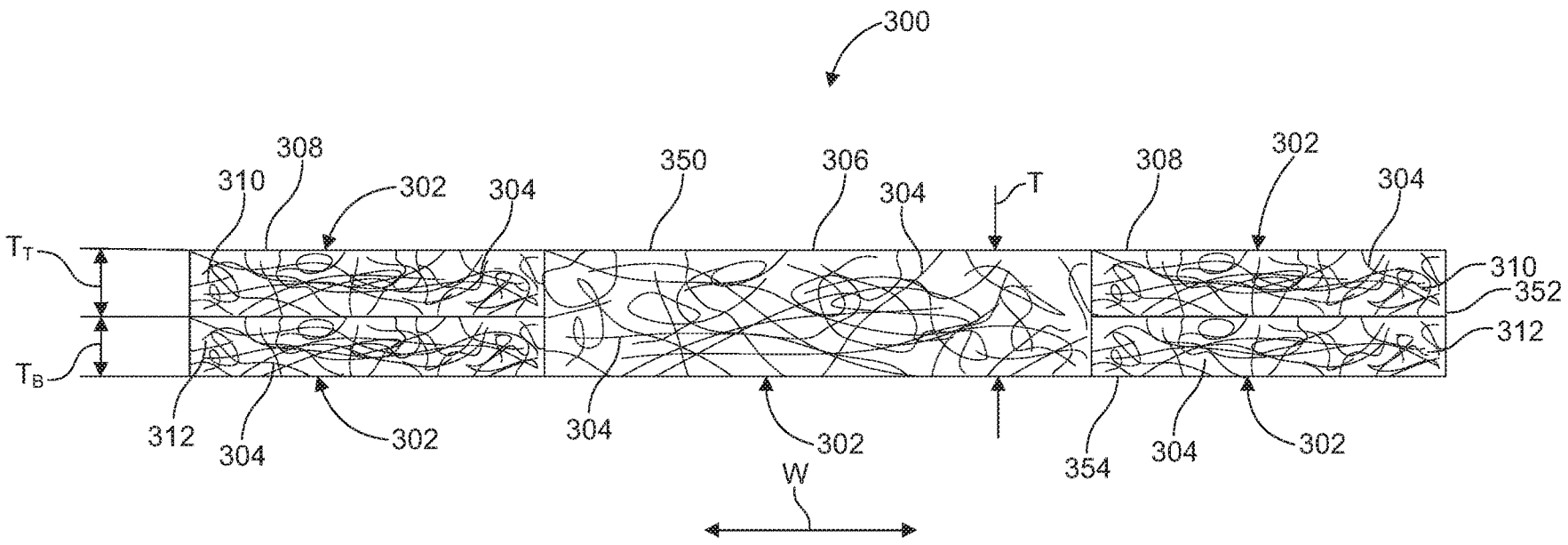
Figure 4:
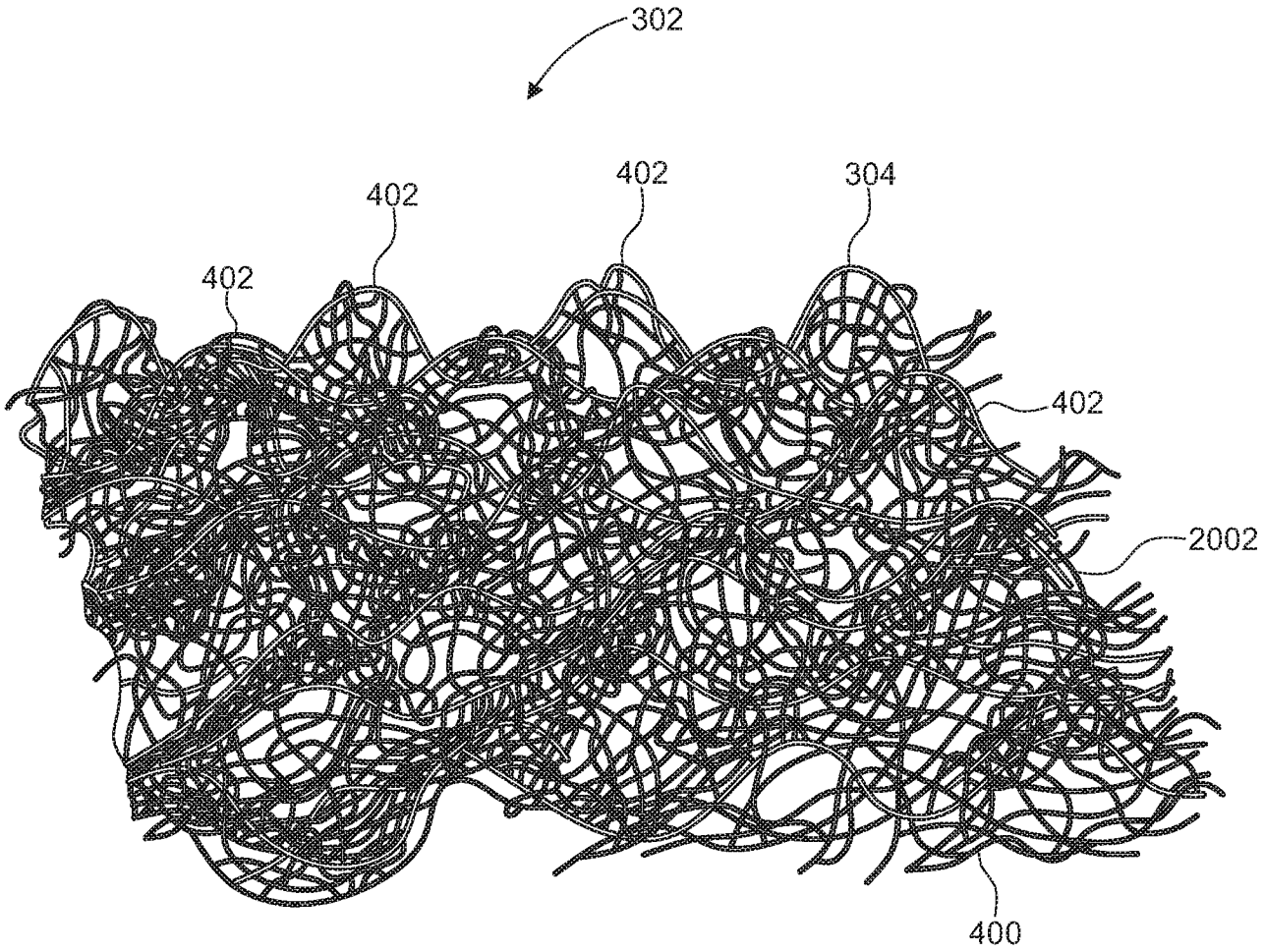
Figure 5:
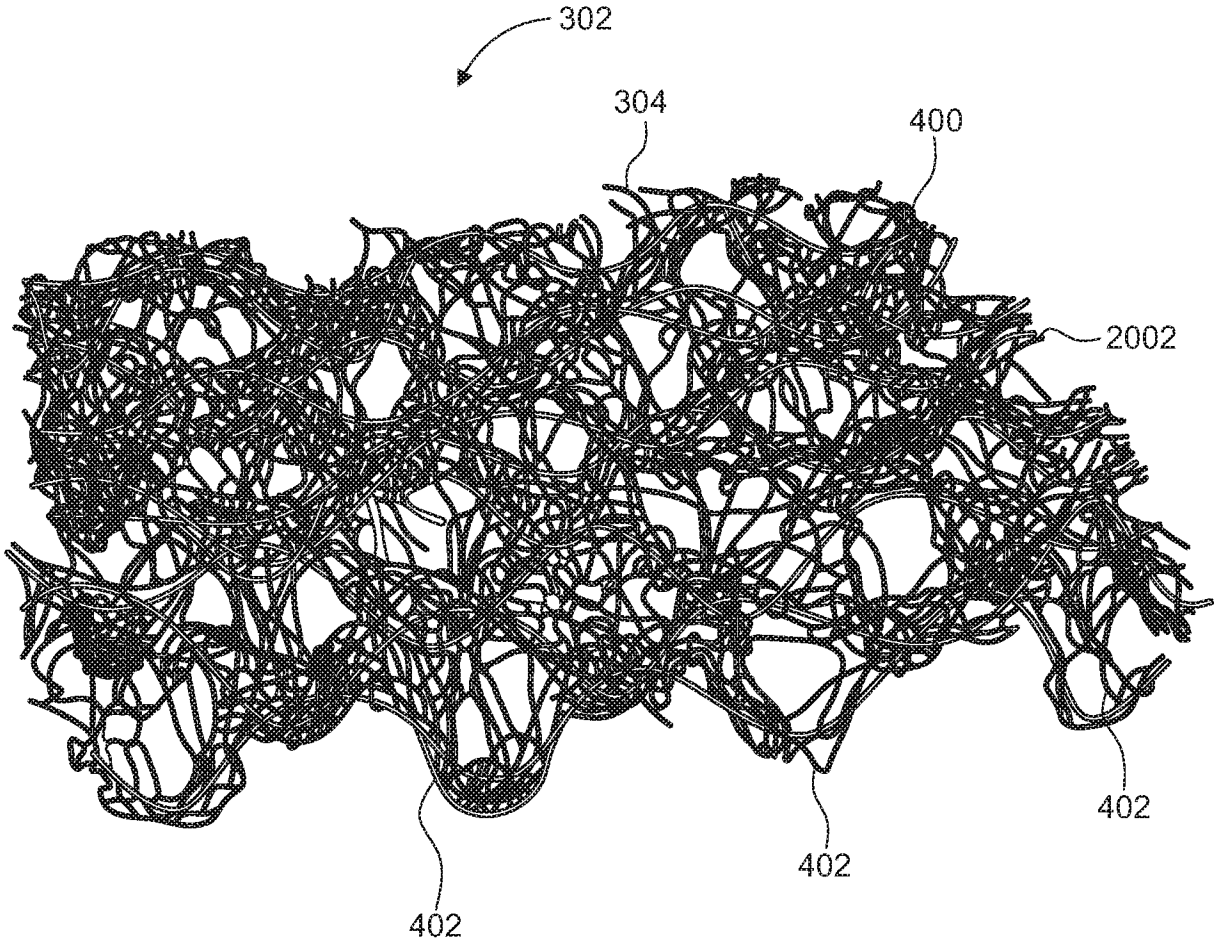
Figure 6A:
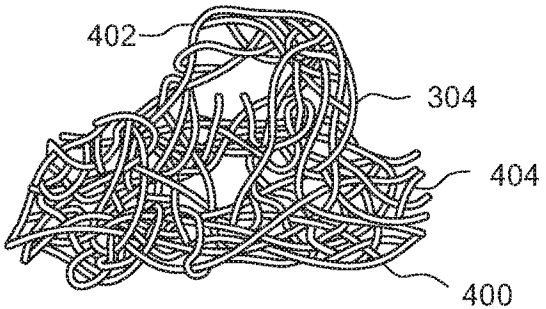
Figure 6B:
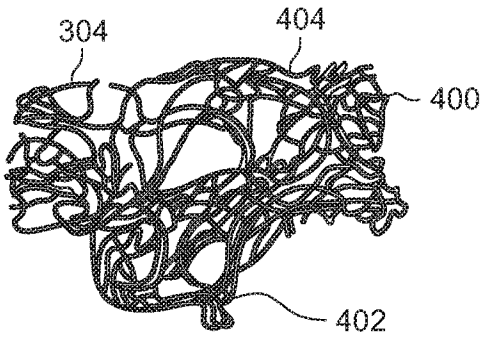
Figure 7A:
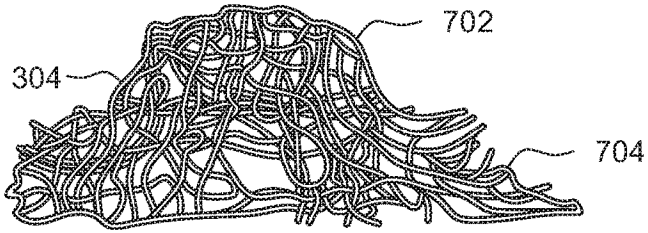
Figure 7B:
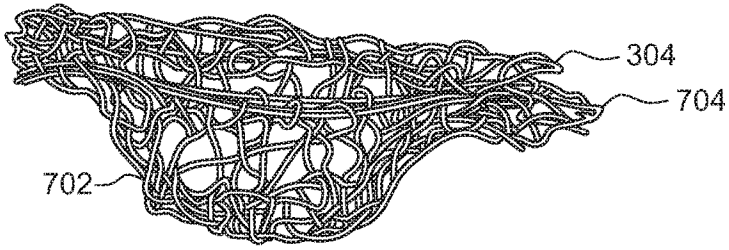
Figure 8:
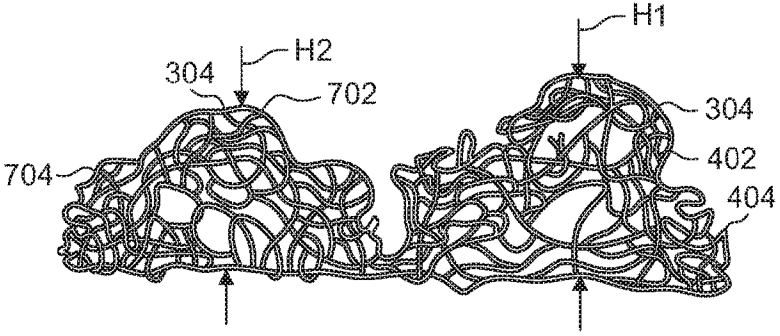
Figure 10:
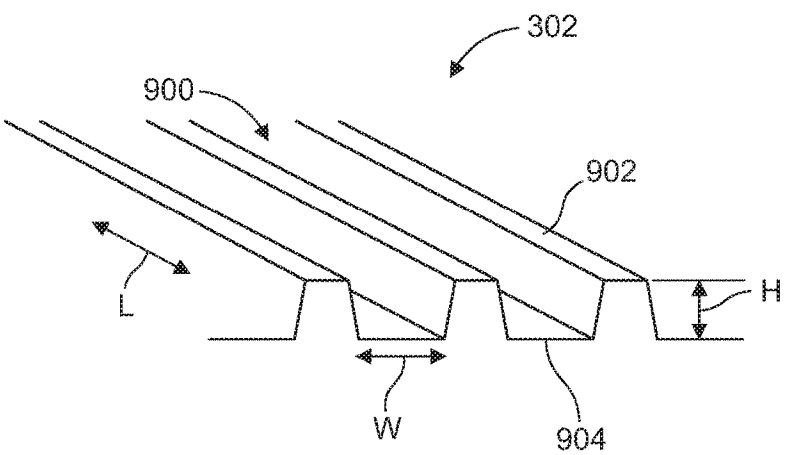
Figure 9A:
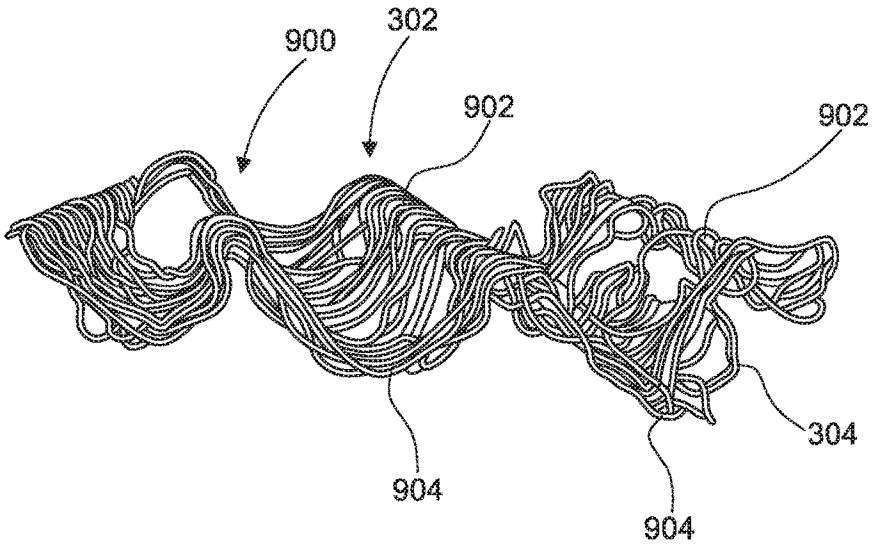
Figure 9B:
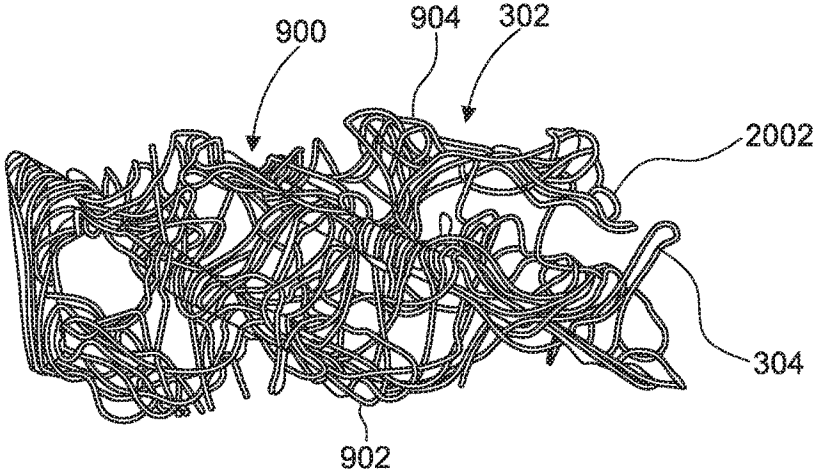
Figure 11C:
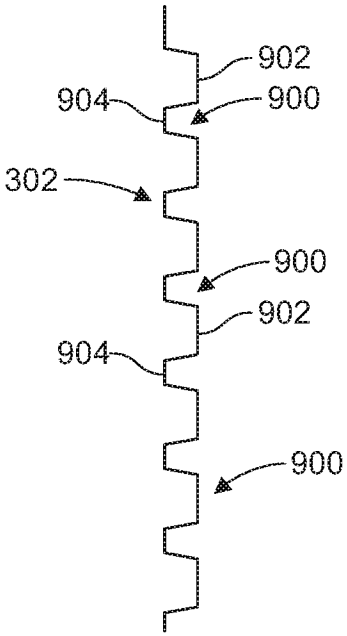
Figure 11B:
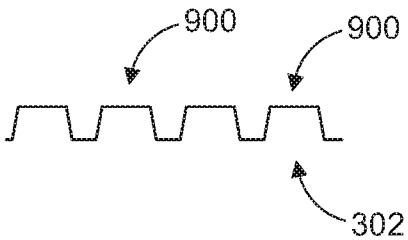
Figure 11A:
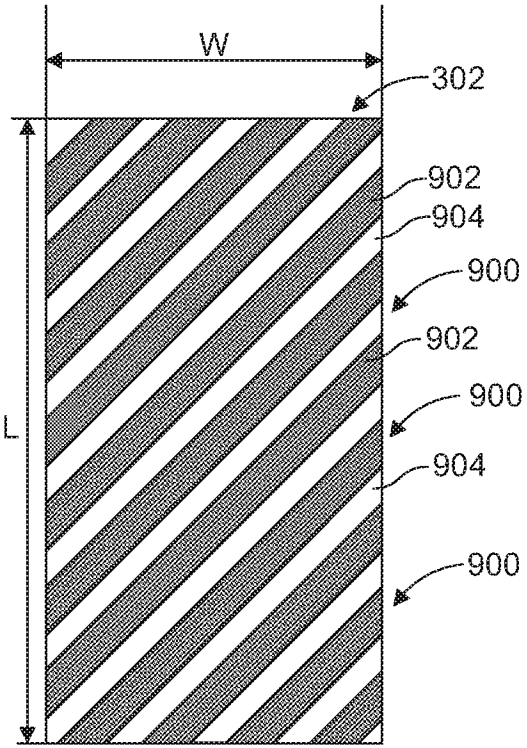
Figure 12A:
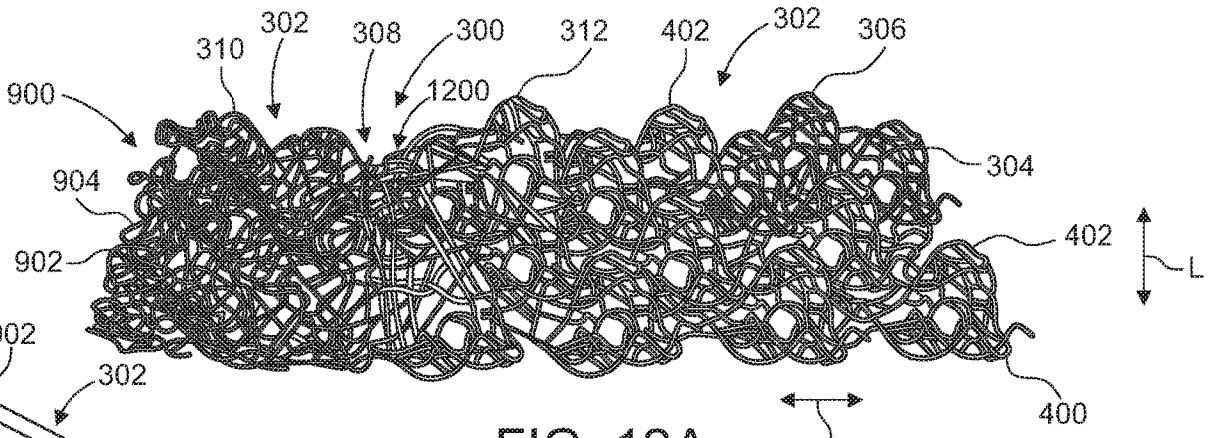
Figure 12B:
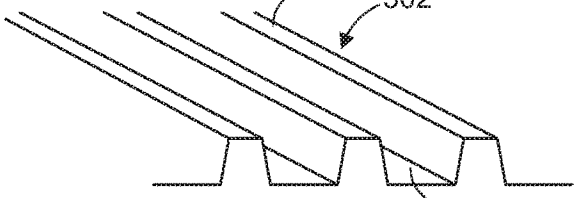
Figure 12C:
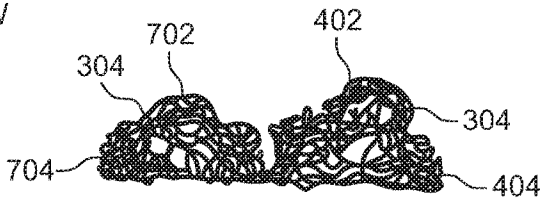
Figure 13:
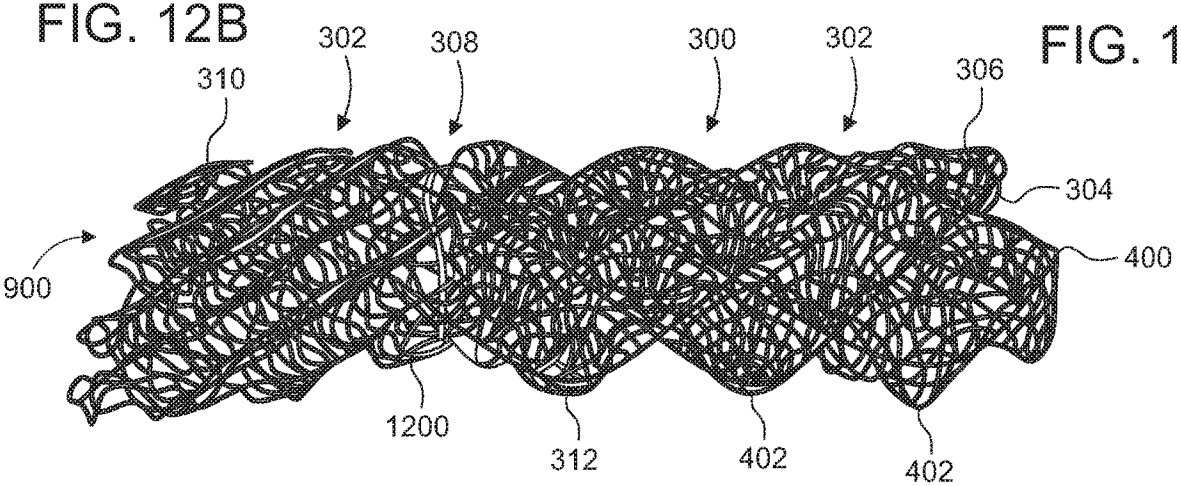
Figures 14A, 14B, 14C, 15A, 15B, 15C:
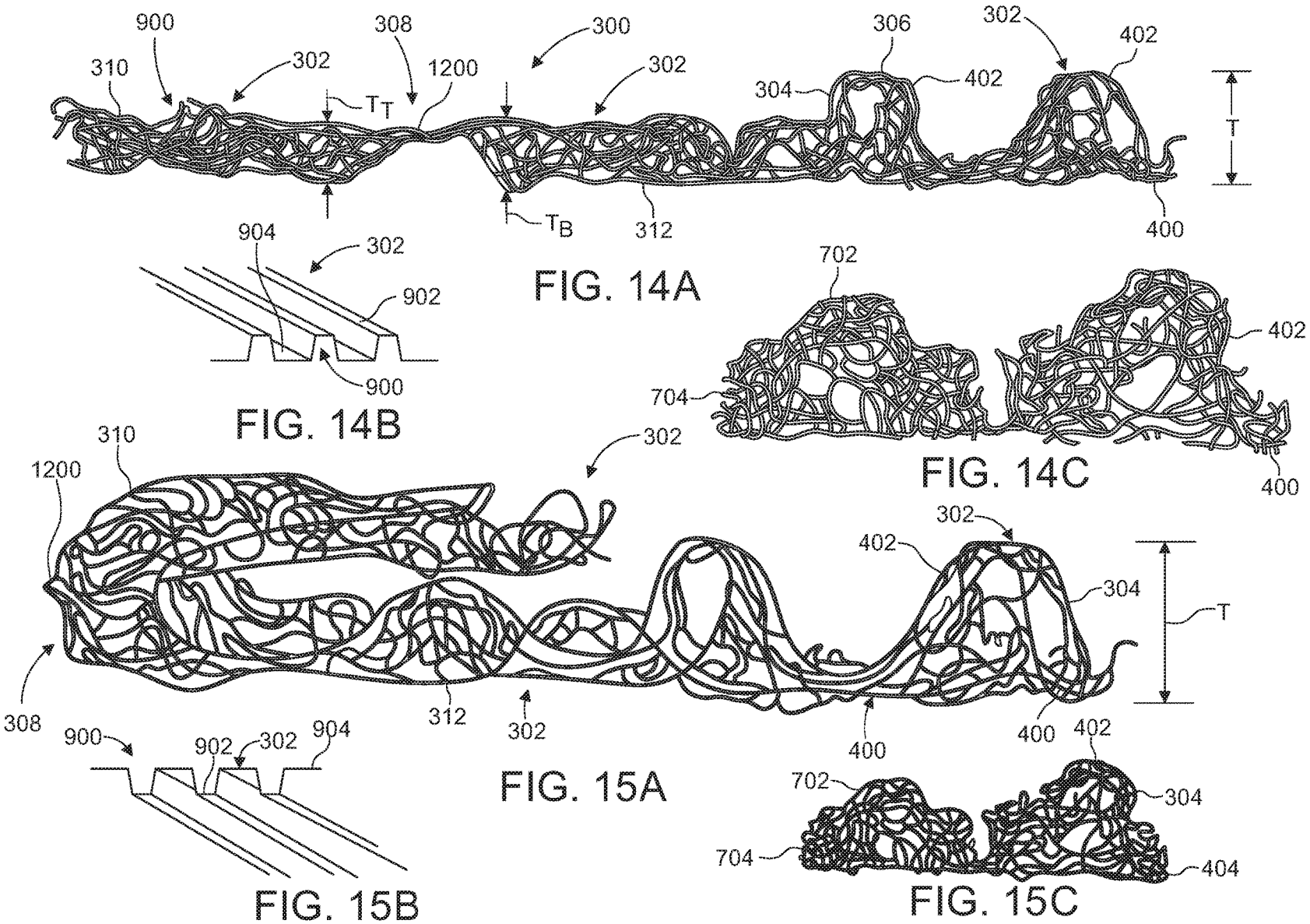
Figure 16A:
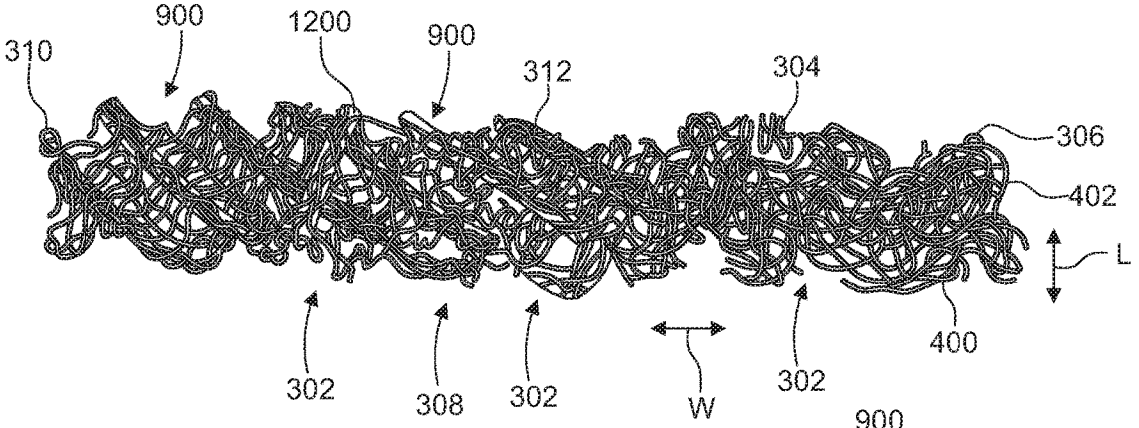
Figure 16B:
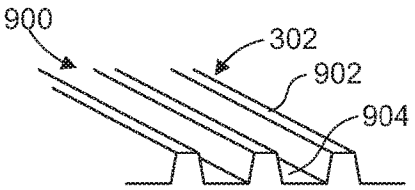
Figure 16C:
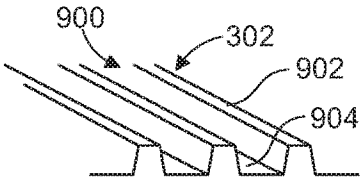
Figure 16D:
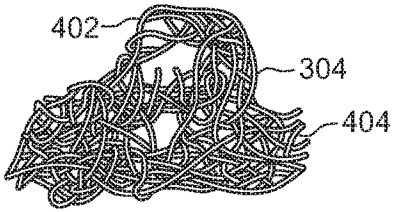
Figure 17A:
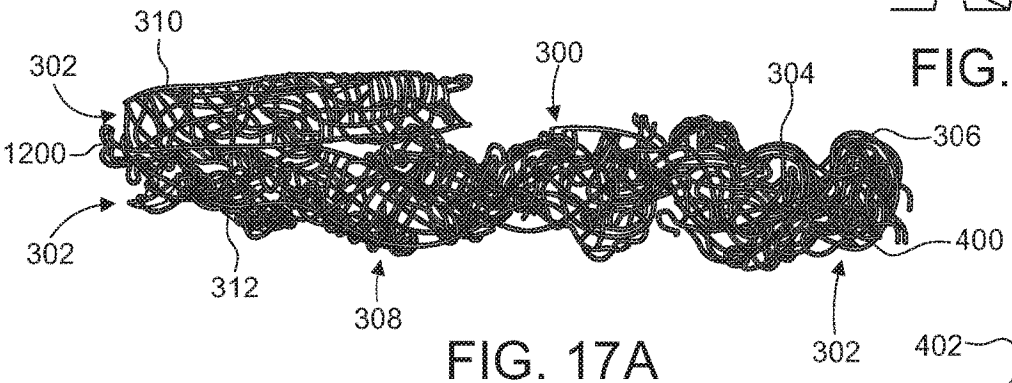
Figure 17B:
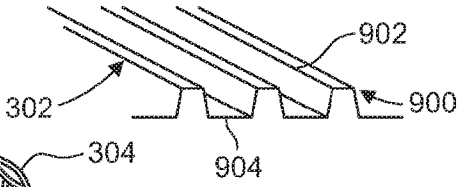
Figure 17D:
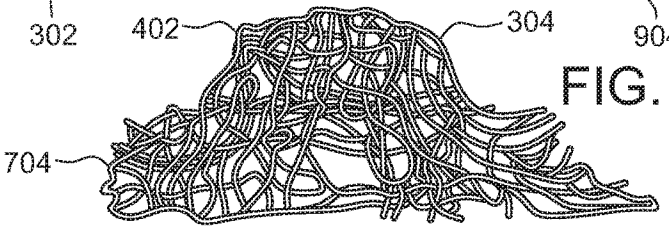
Figure 17C:
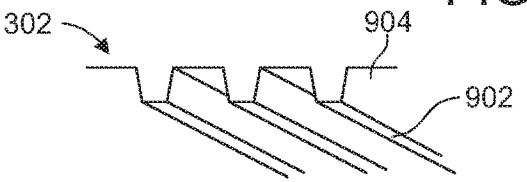
Figure 18C:
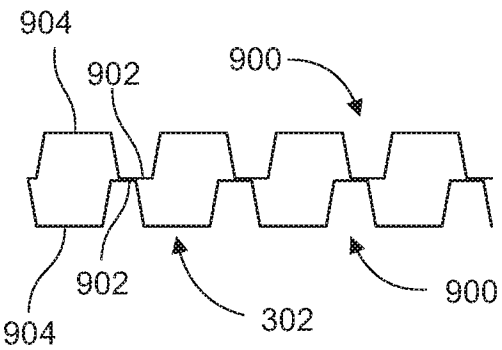
Figure 18B:
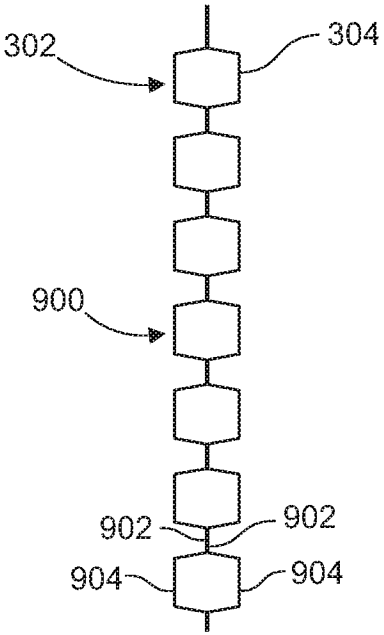
Figure 18A:
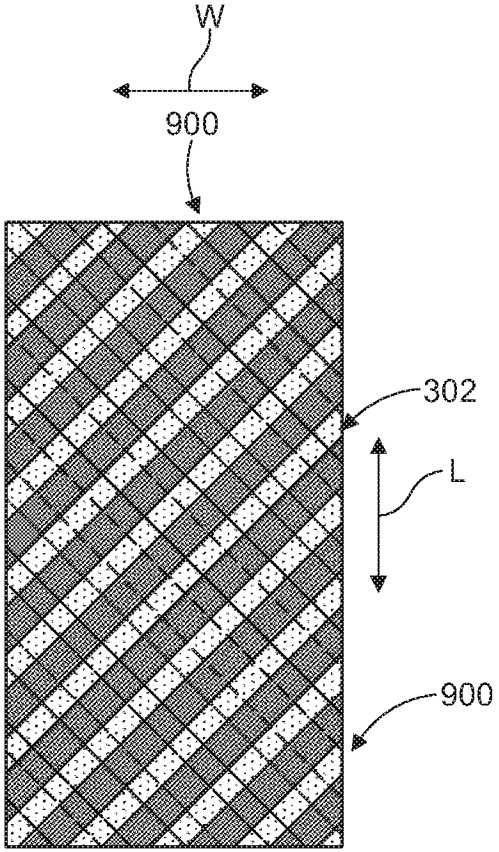
Figures 19A, 19B:
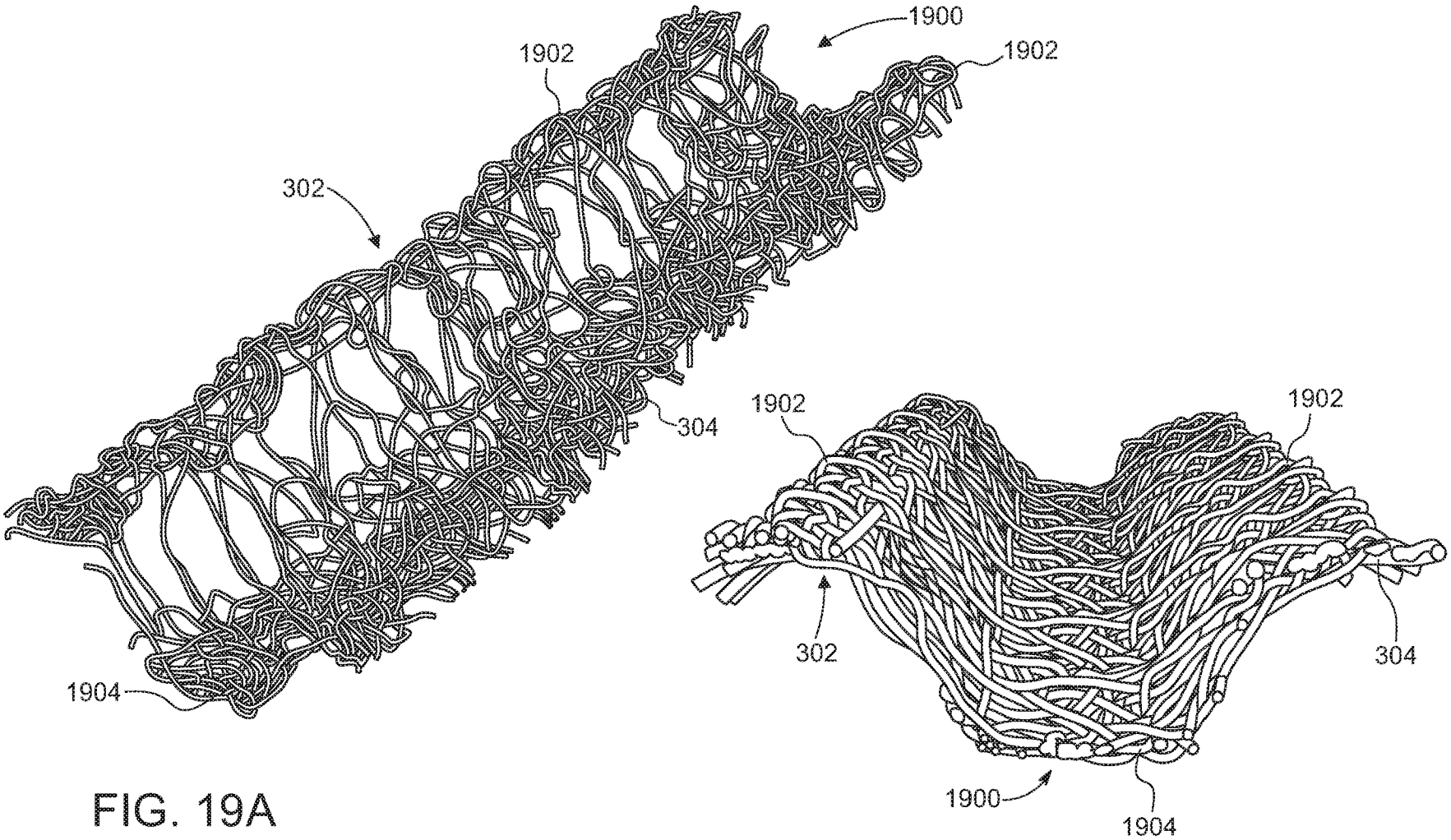
Figure 20A:
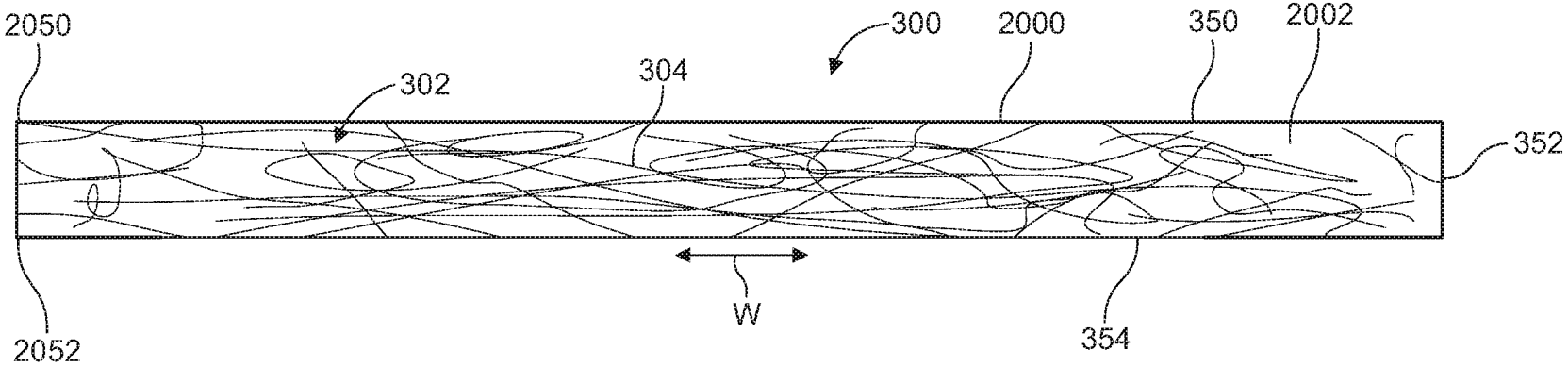
Figure 20B:
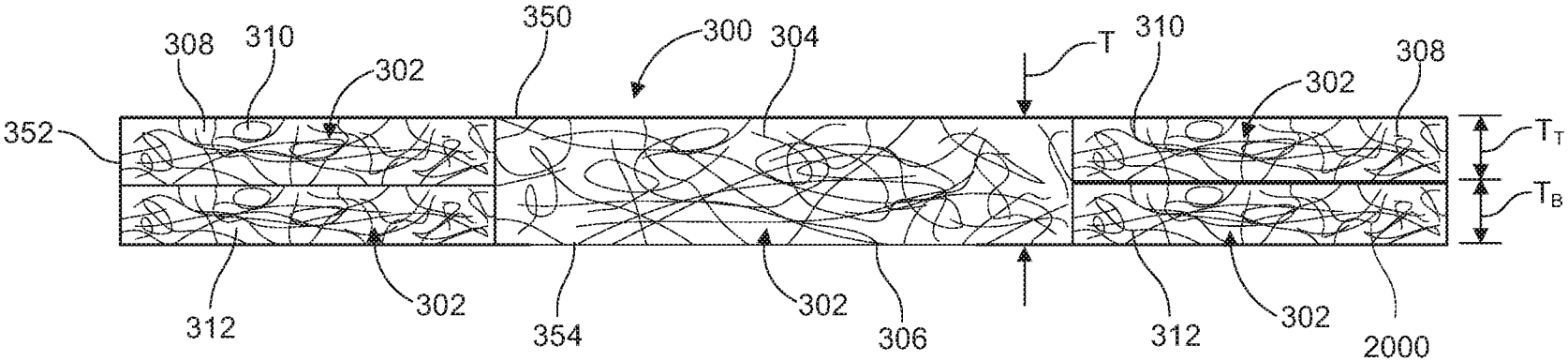
Figure 21:
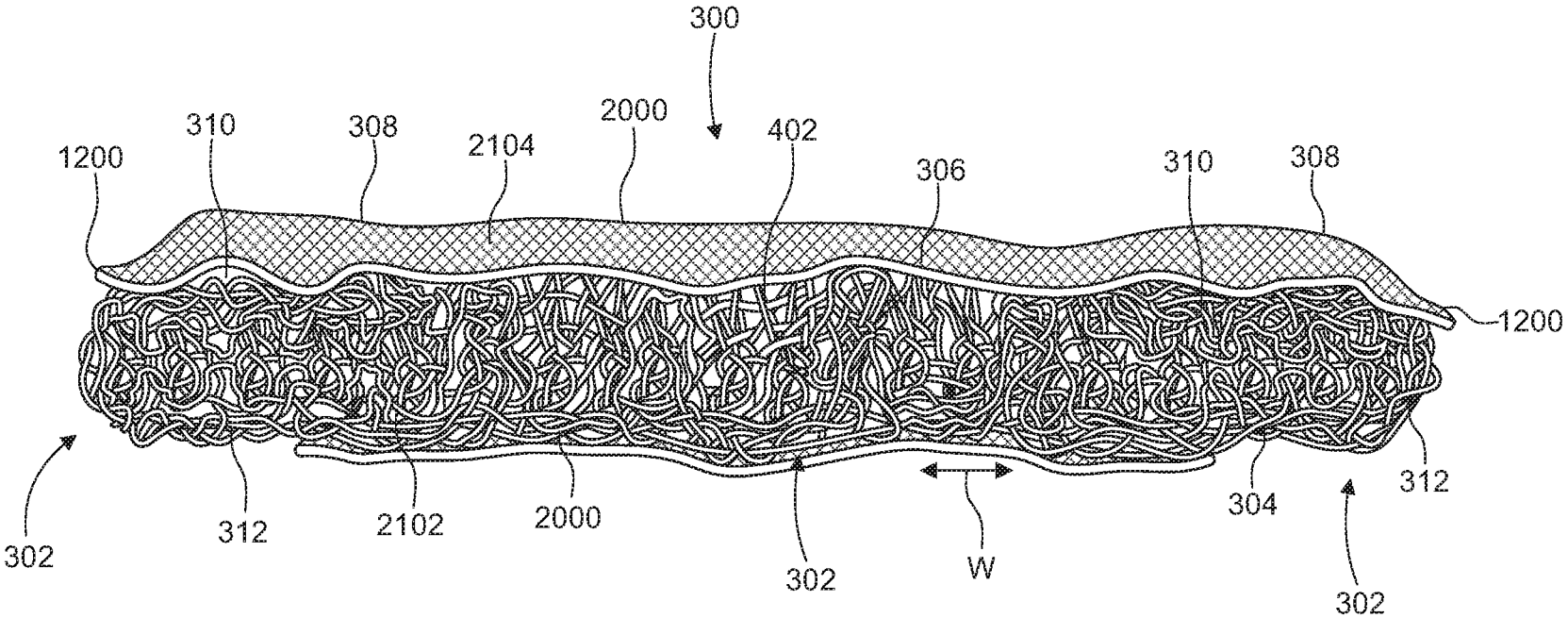
Figure 22:
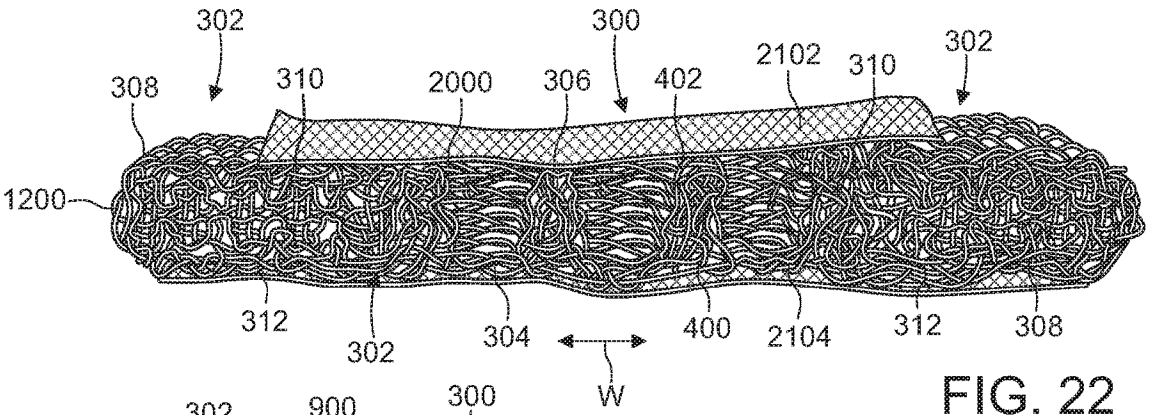
Figure 23:
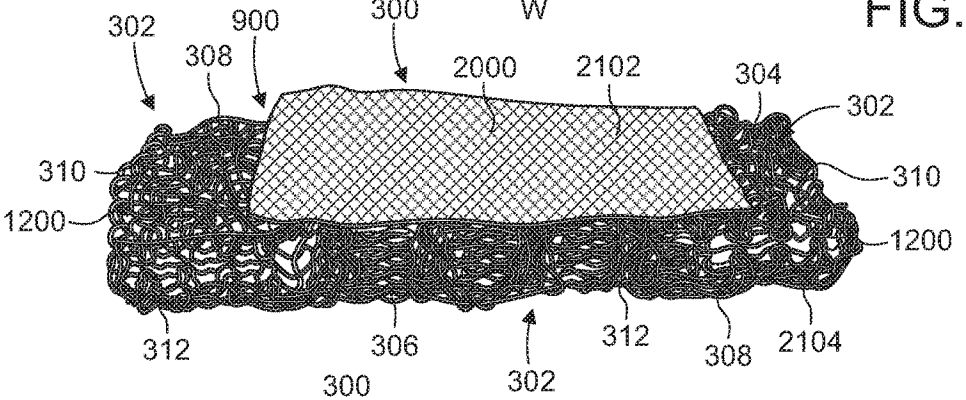
Figure 24:
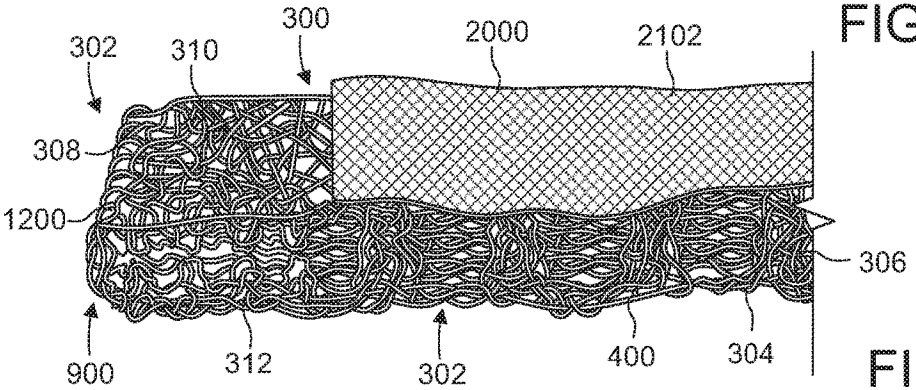
Figure 25:
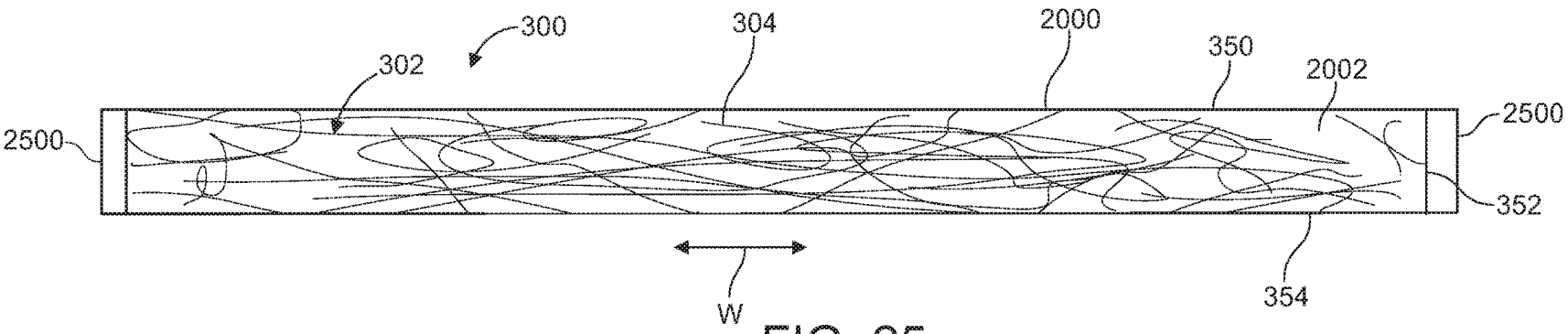
Figure 26:
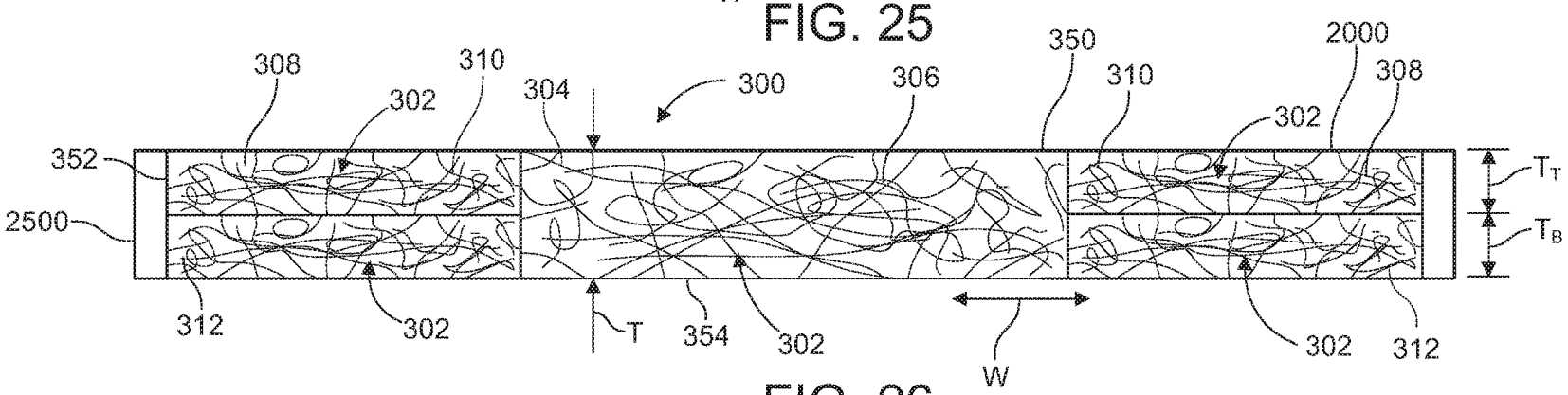
Figure 27:
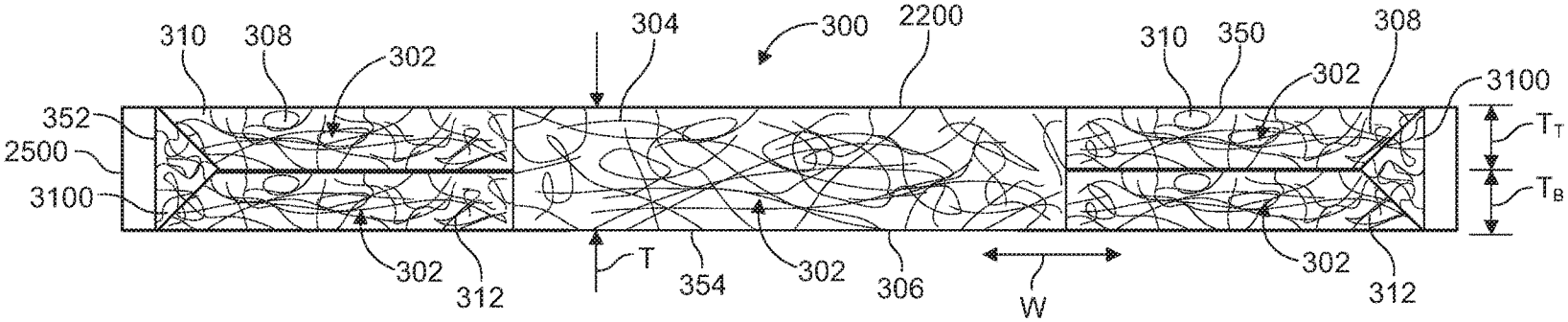
Figure 28:
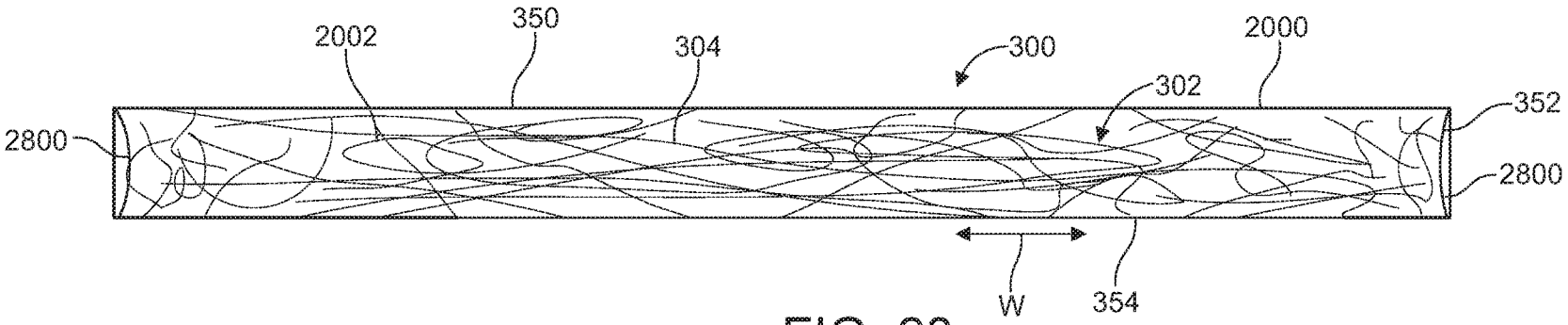
Figure 29:
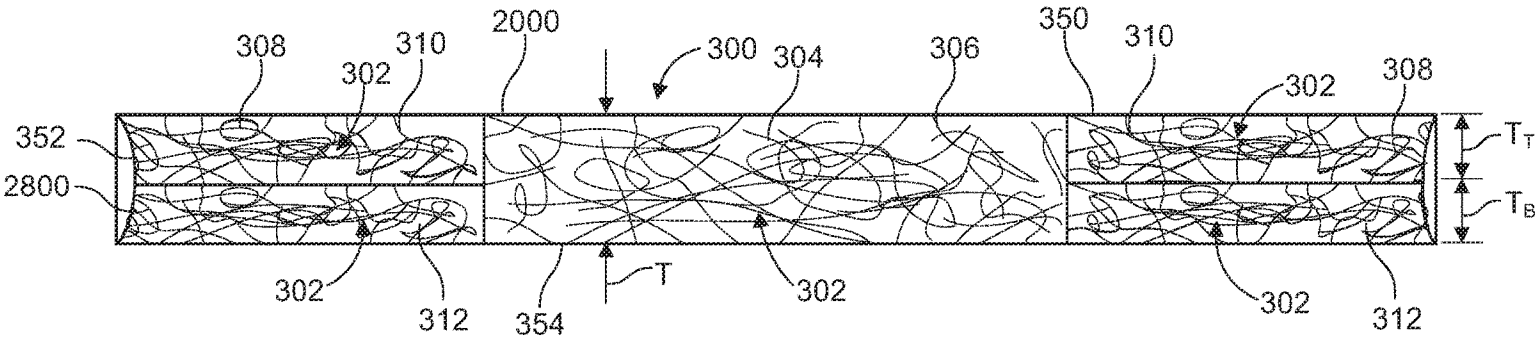
Figure 30:
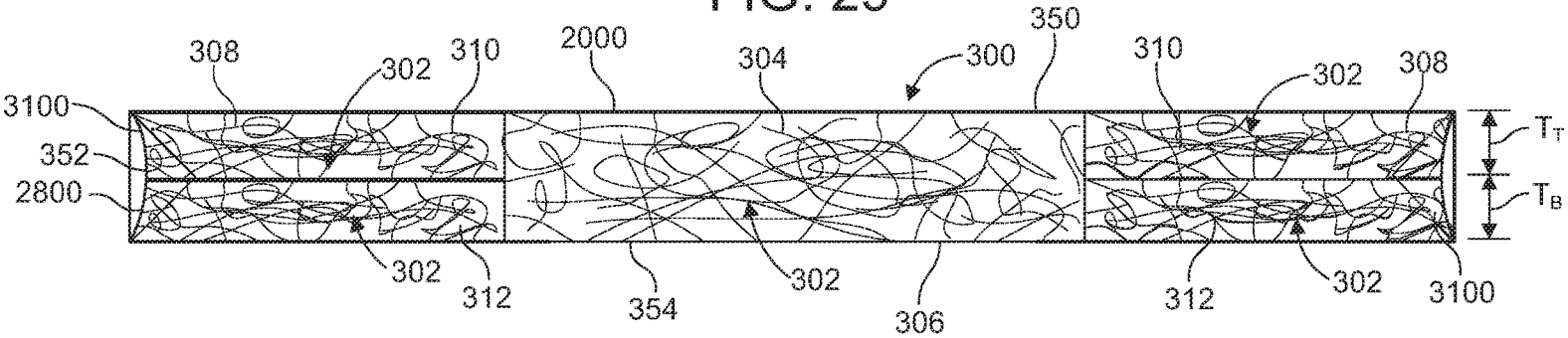
Figure 31:
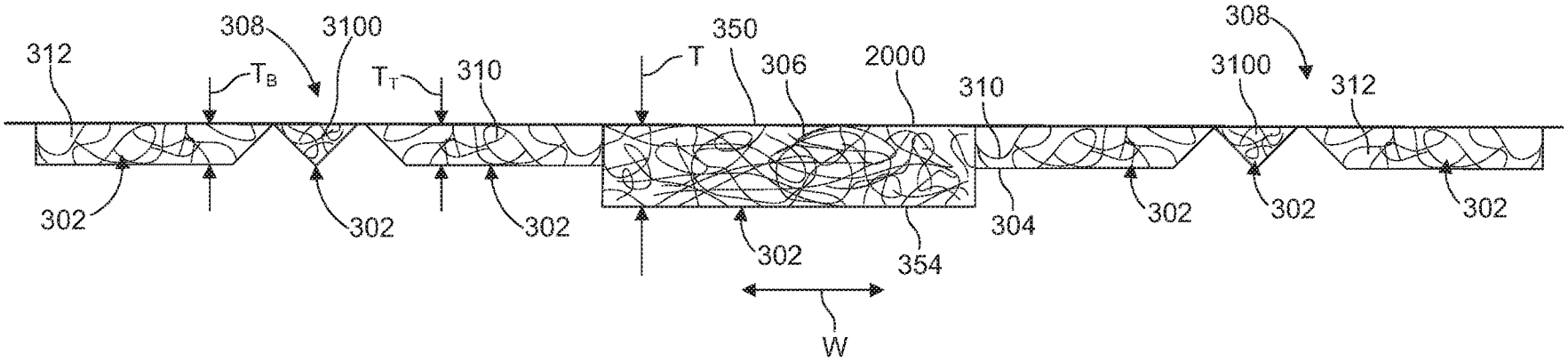
Figure 32:
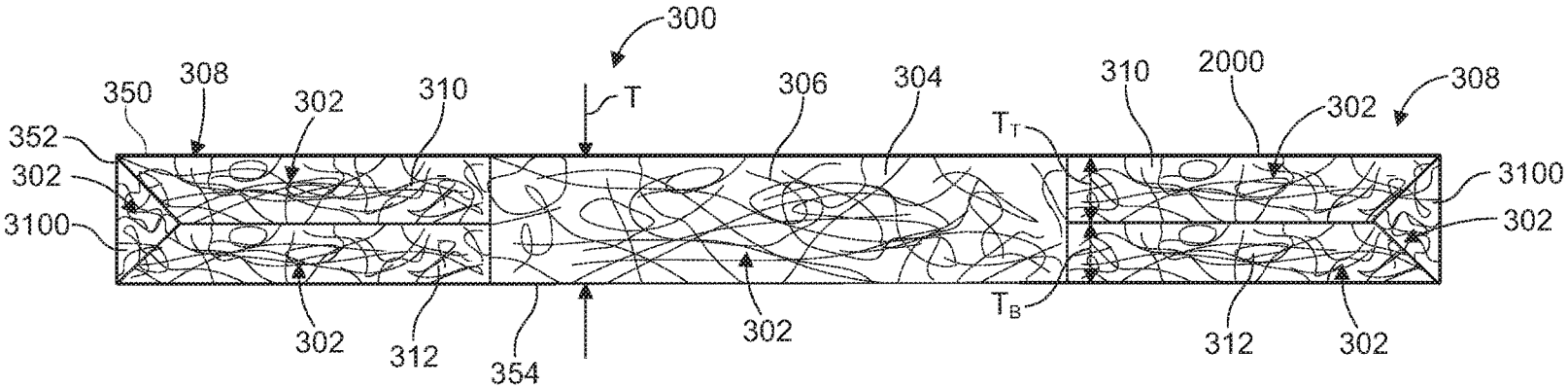
Figure 33:
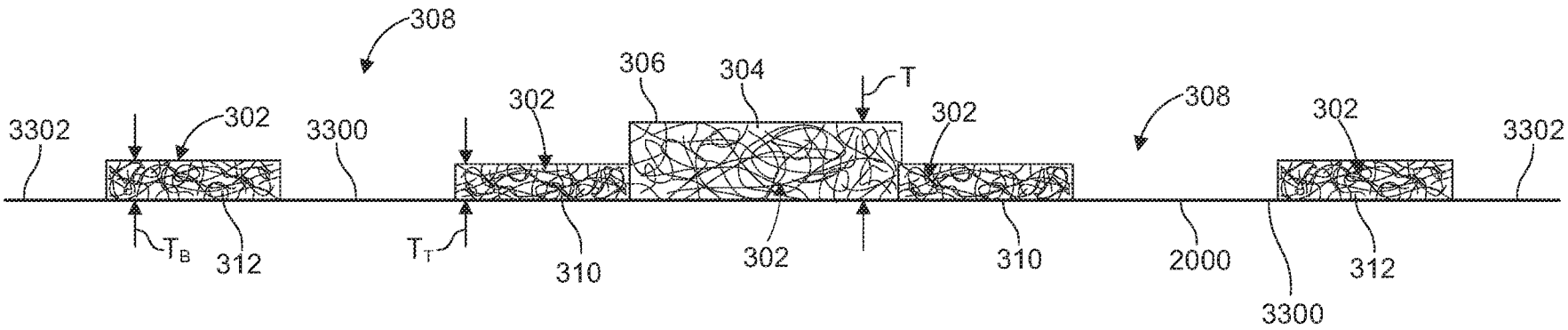
Figure 34:
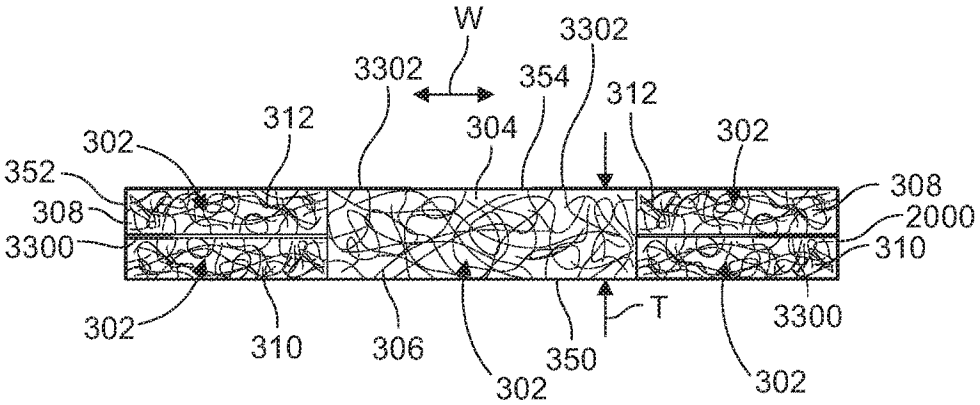
Figure 35:
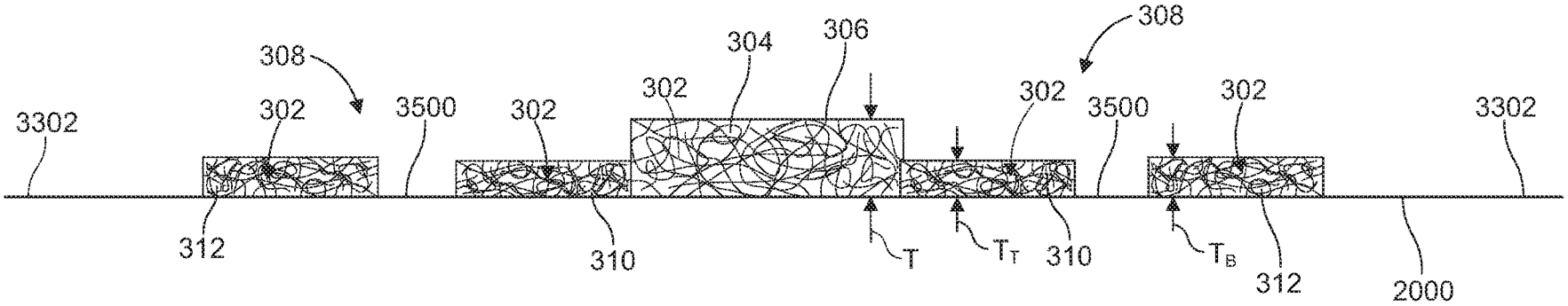
Figure 36:
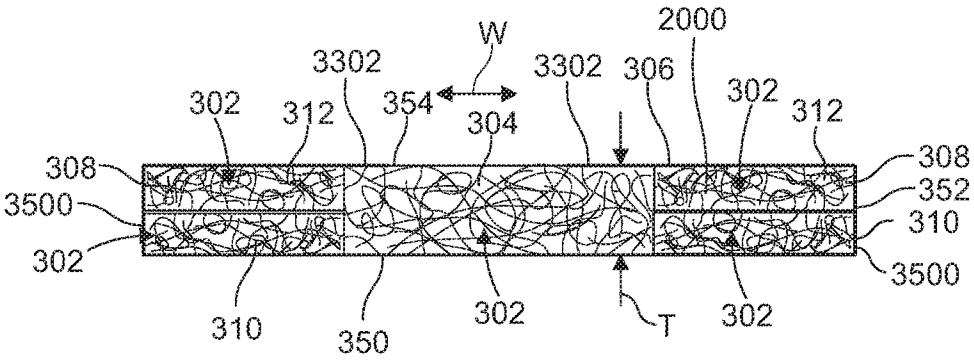
Figure 37:
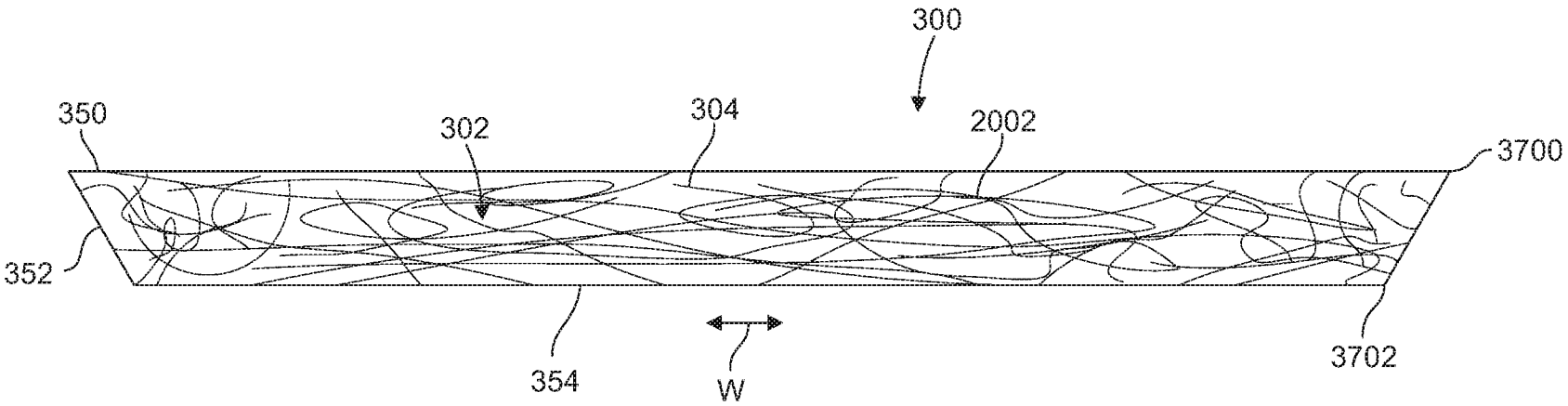
Figure 38:
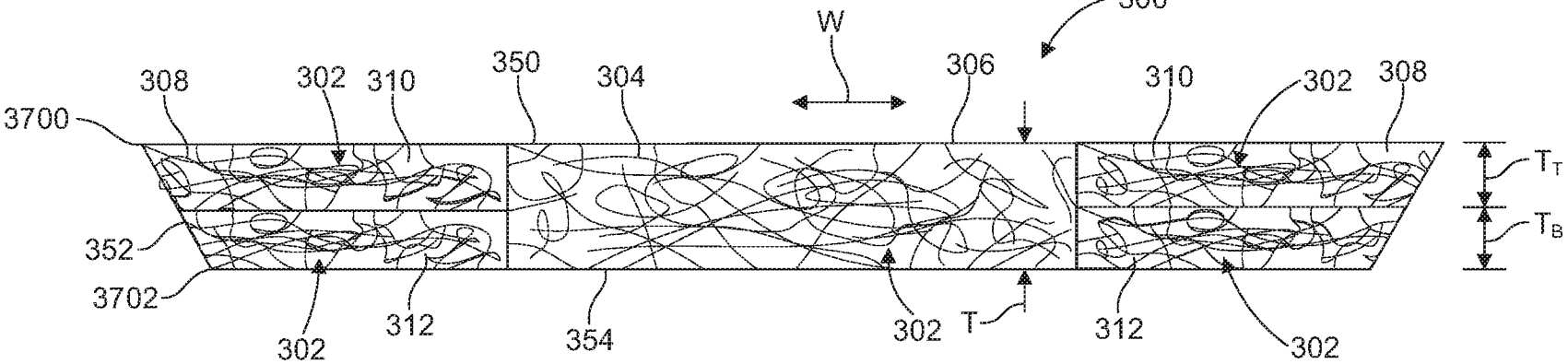
Figure 39:
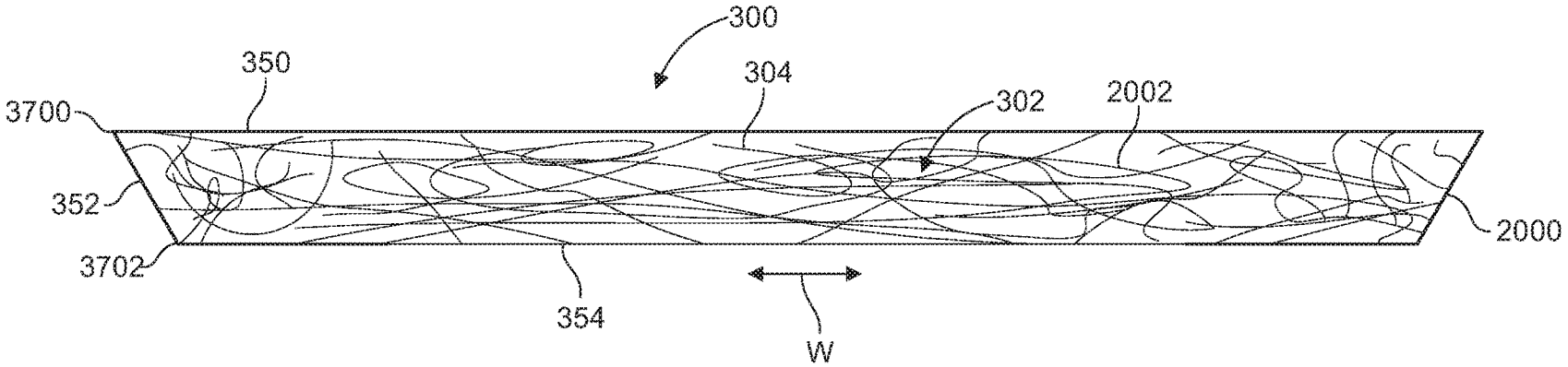
Figure 40:
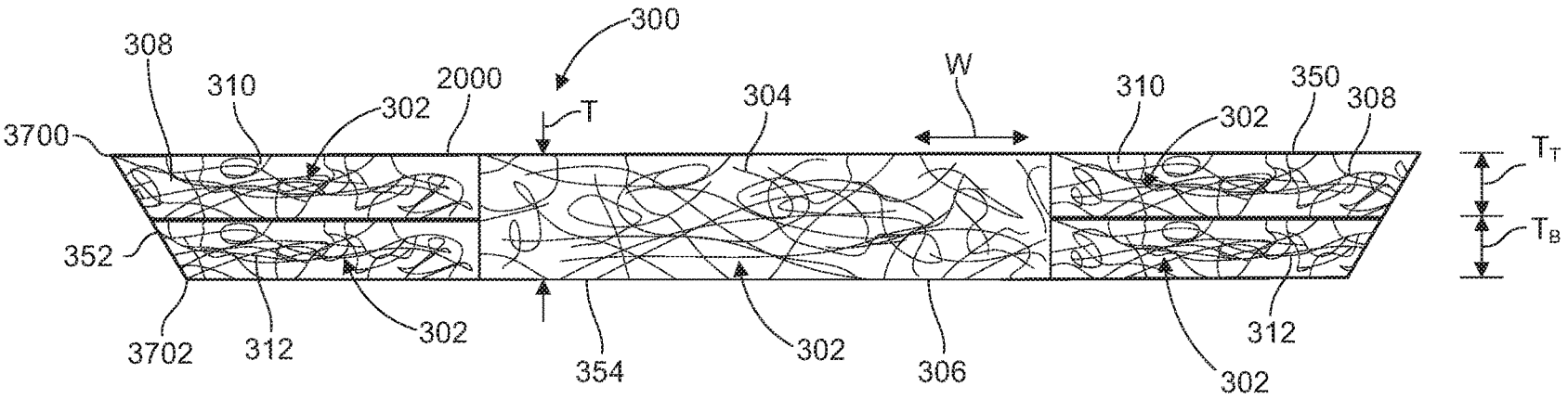
Figure 41:
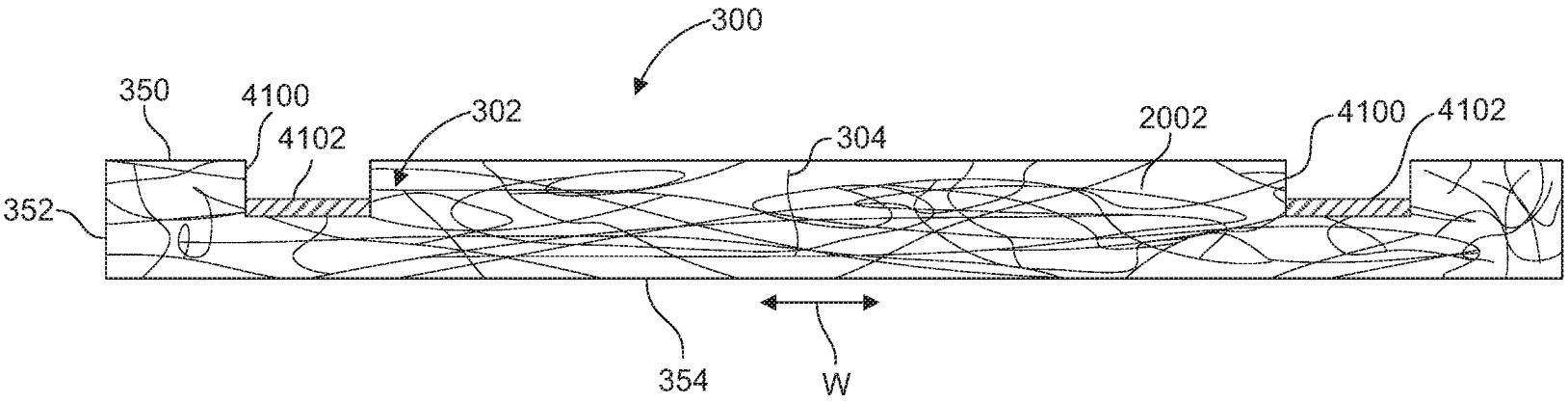
Figure 42:
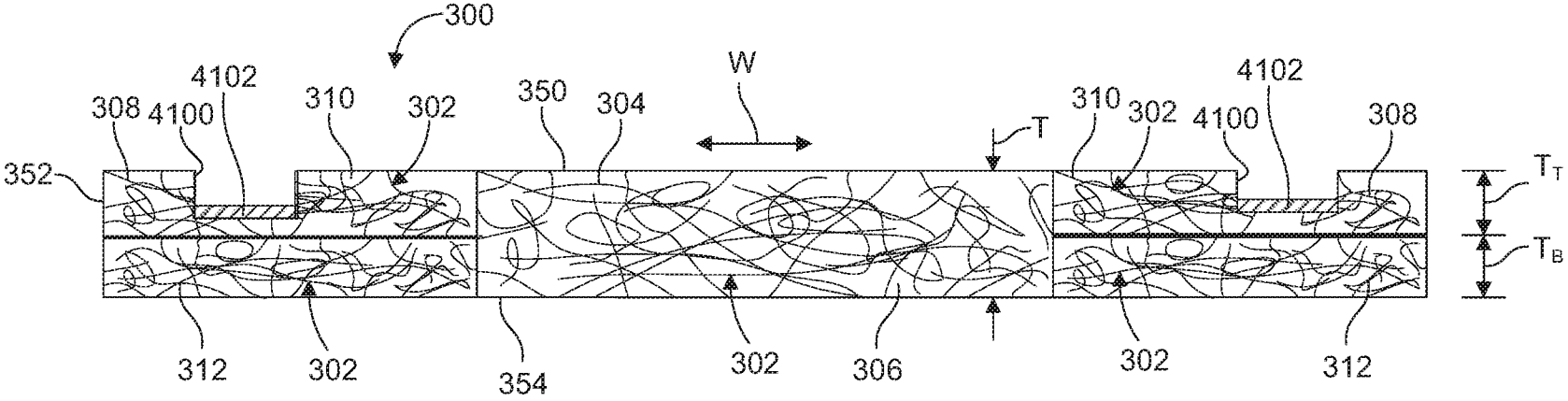
Figure 43:
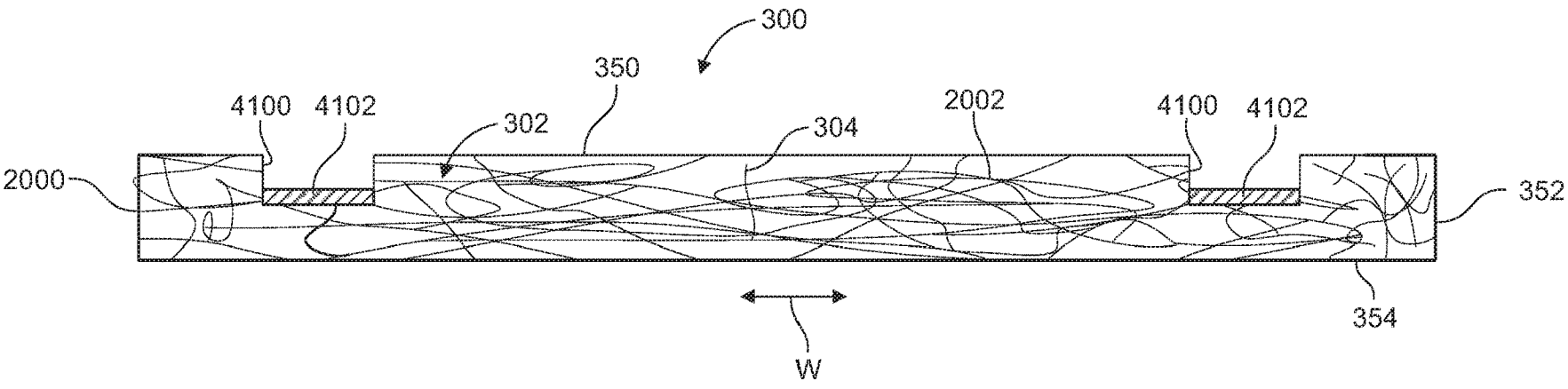
Figure 44:
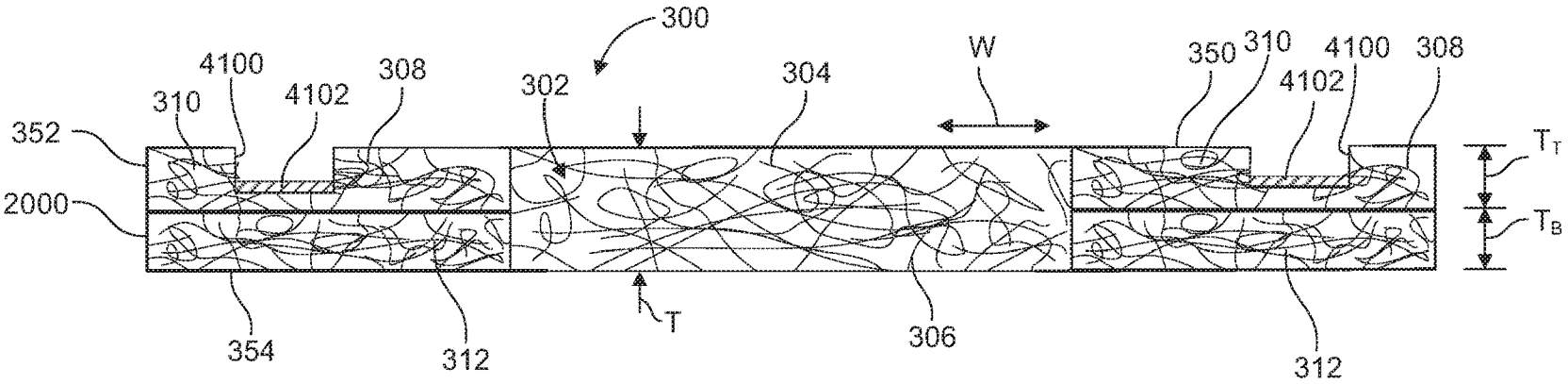
Figure 45:
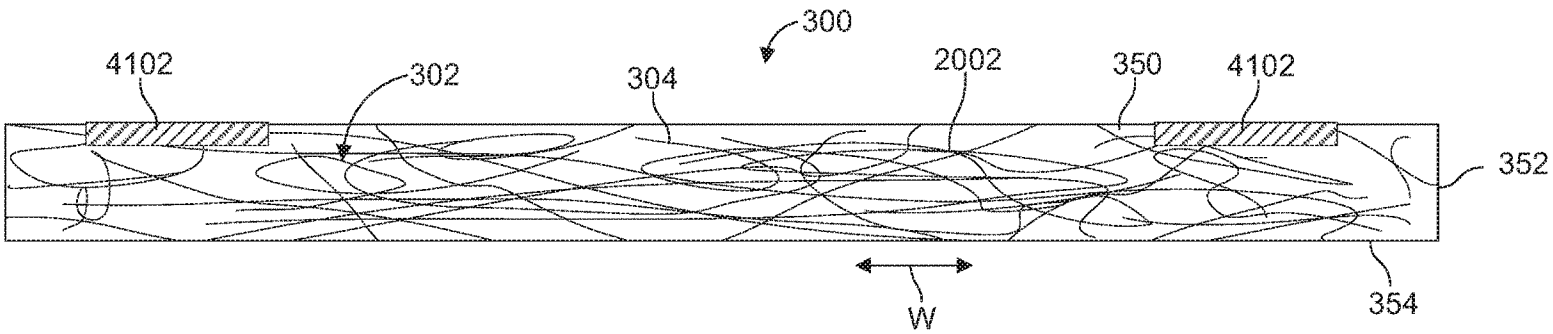
Figure 46:
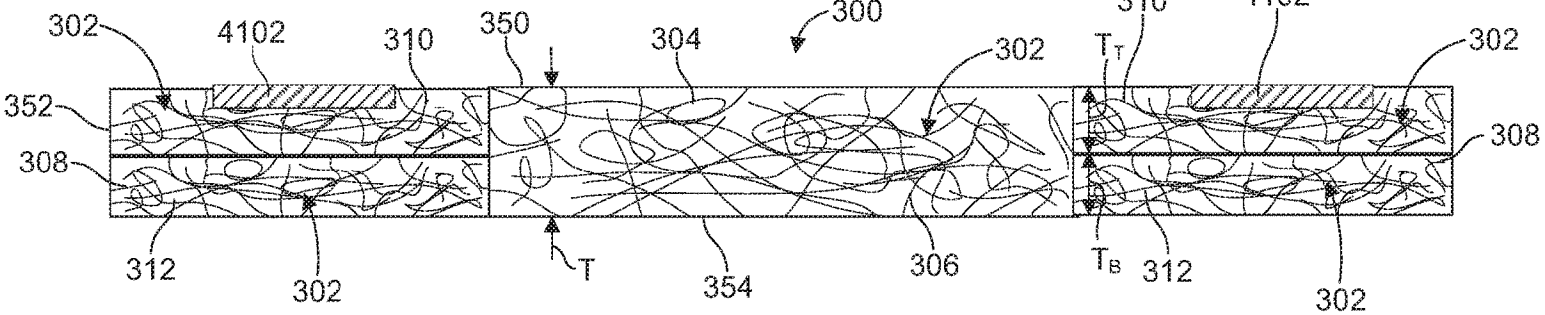
Figure 47:
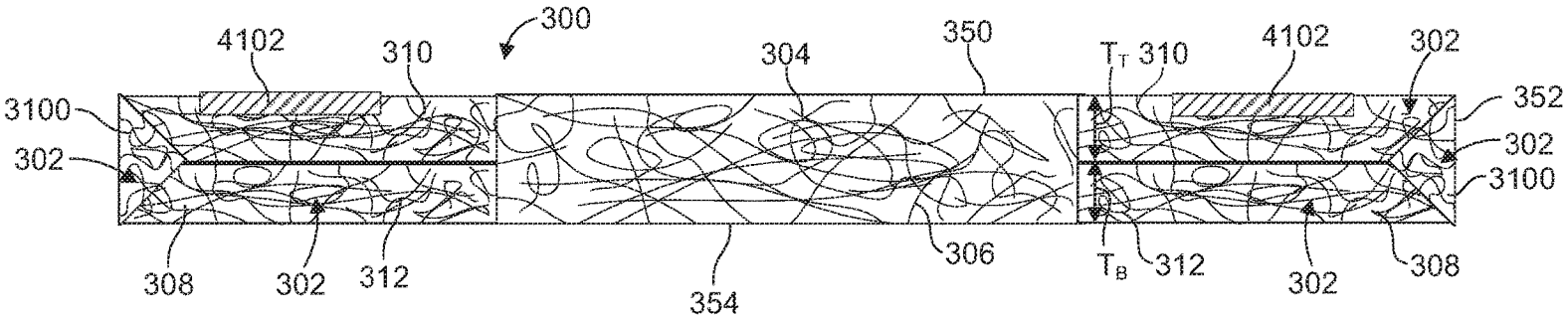
Figure 48:
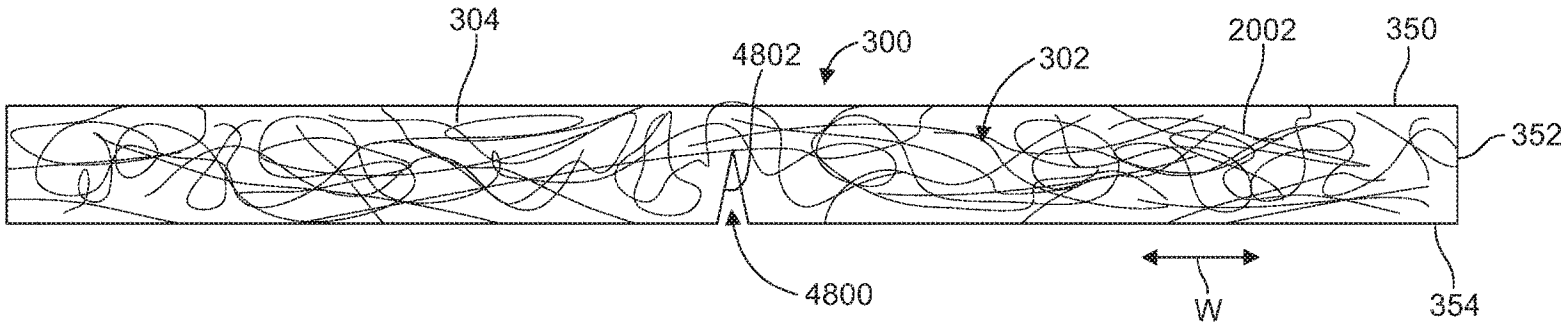
Figure 49:
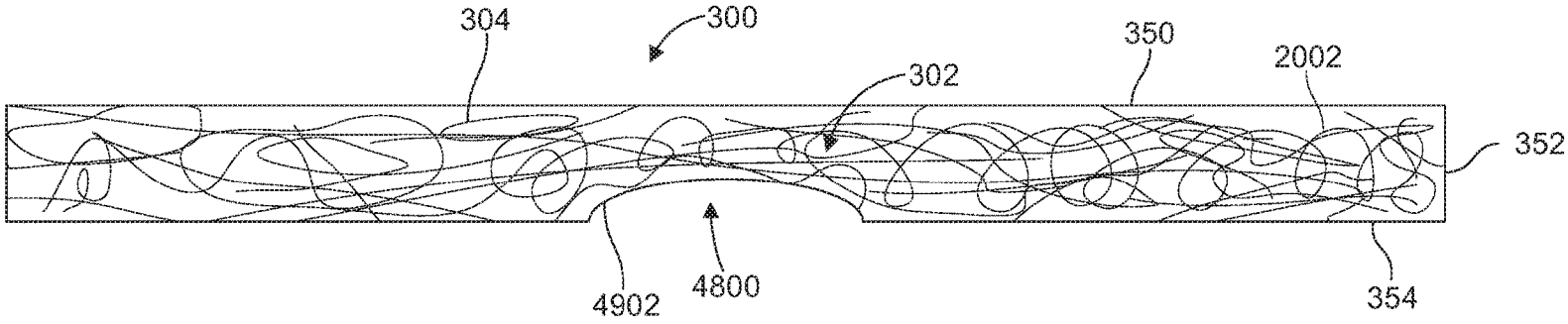
Figure 50:
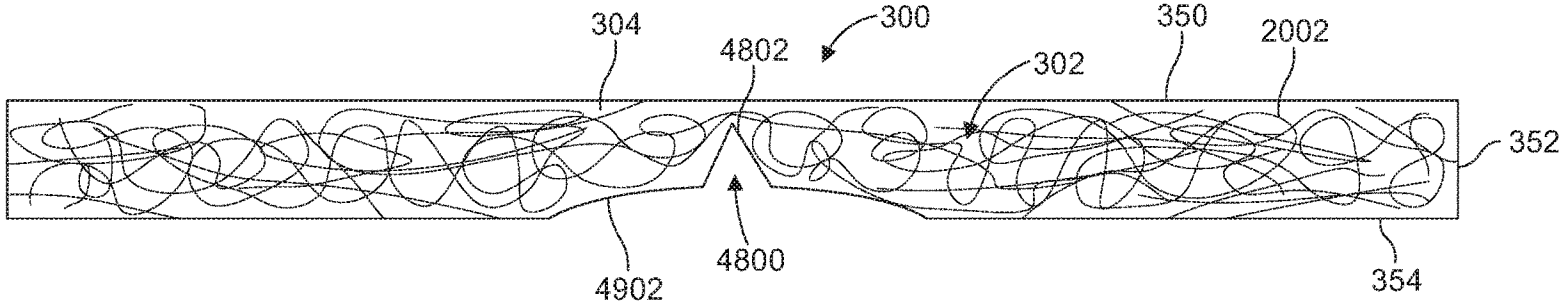
Figure 51:
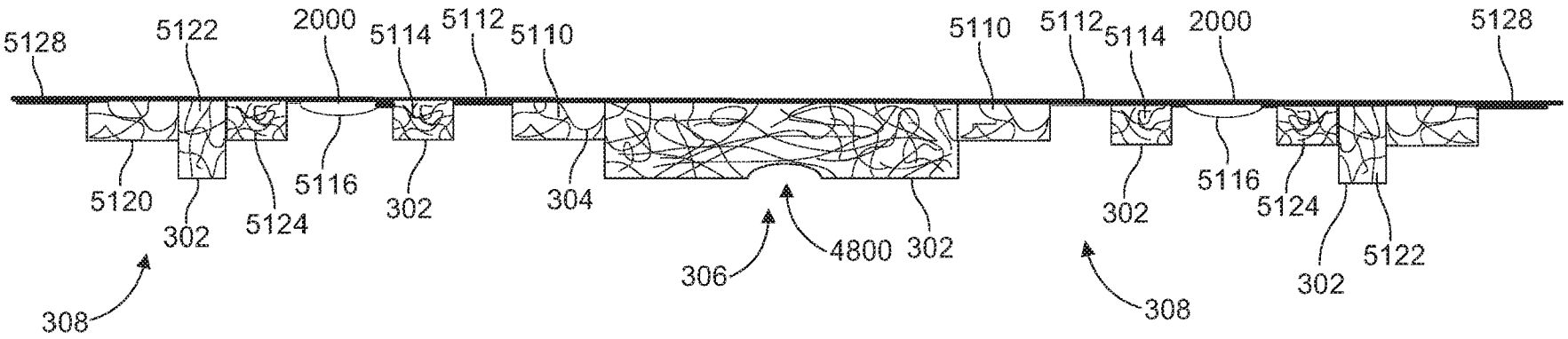
Figure 52:
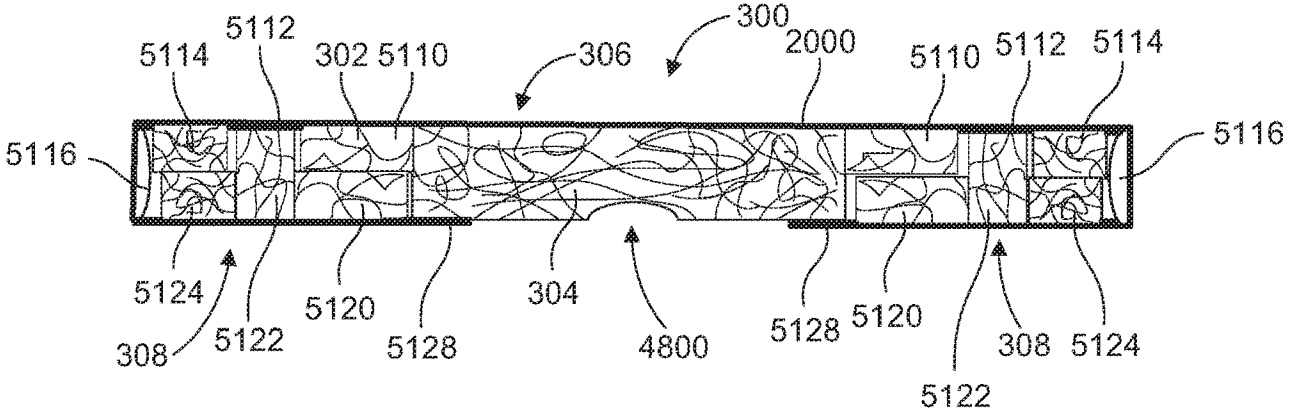
Figure 53:
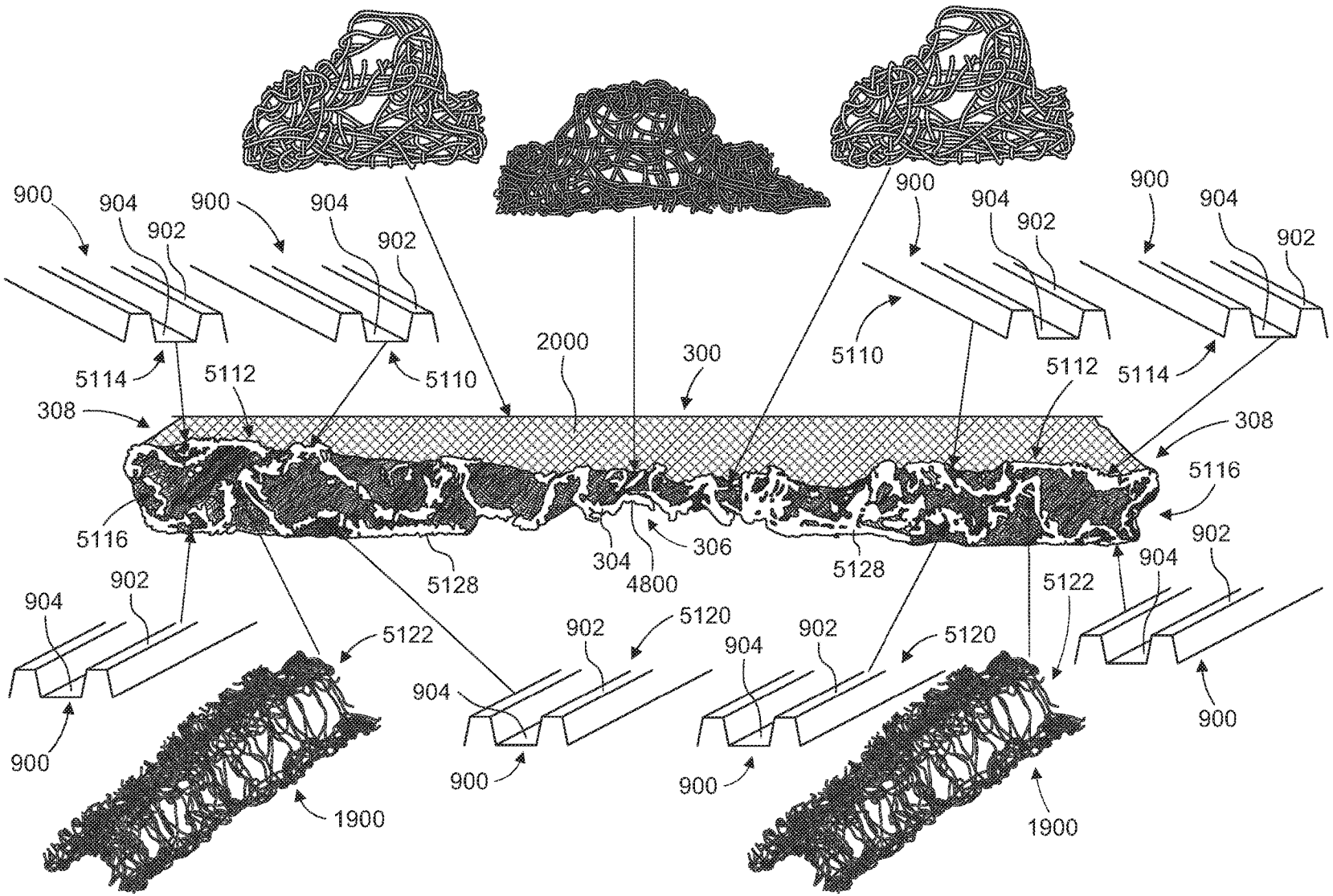
Figure 54A:
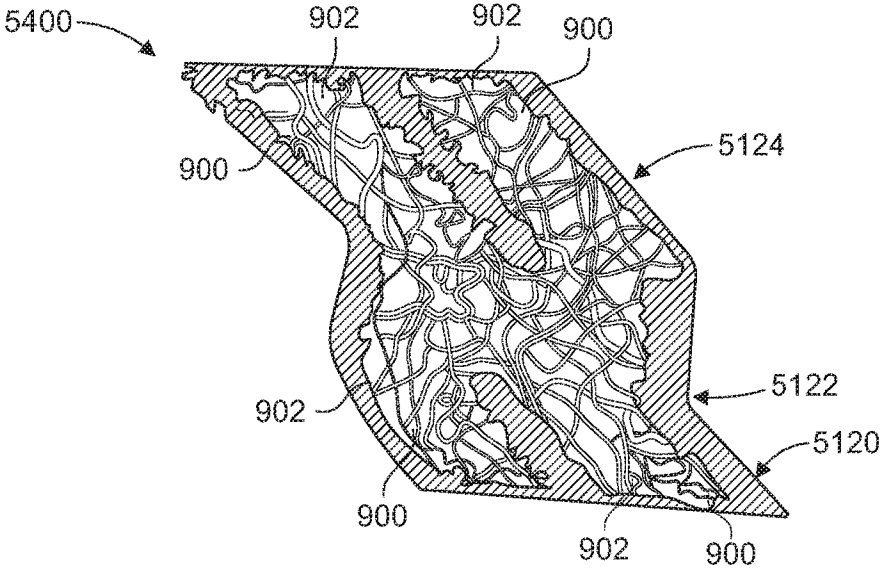
Figure 54C:
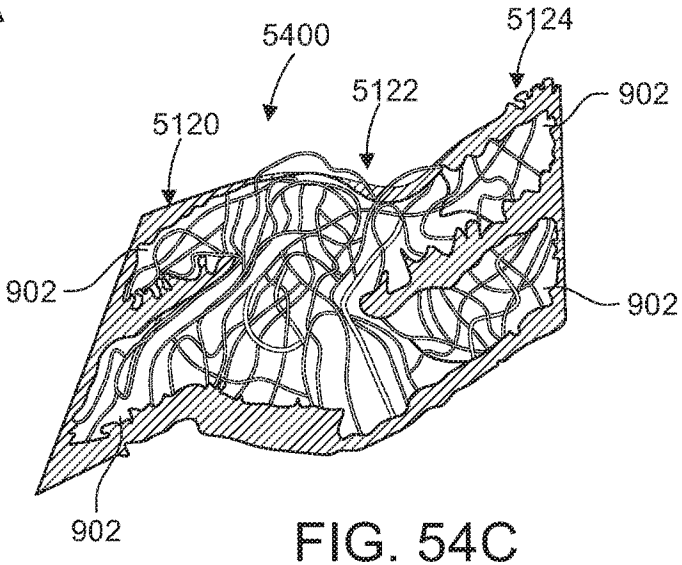
Figure 54B:
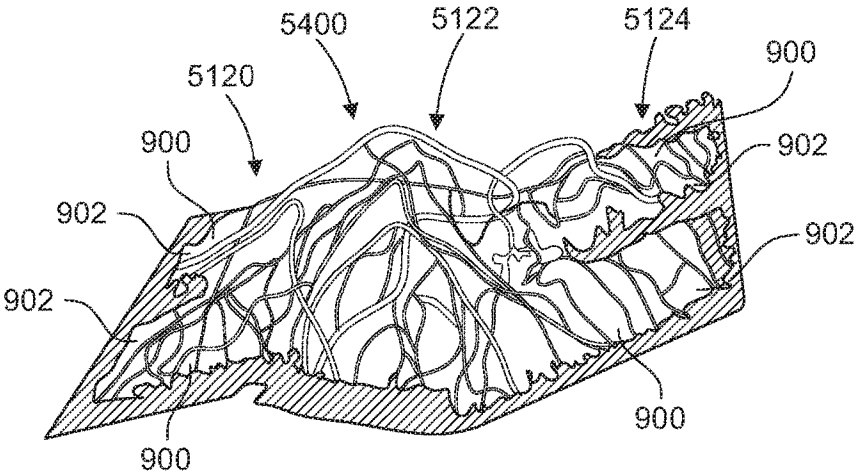
Figure 55:
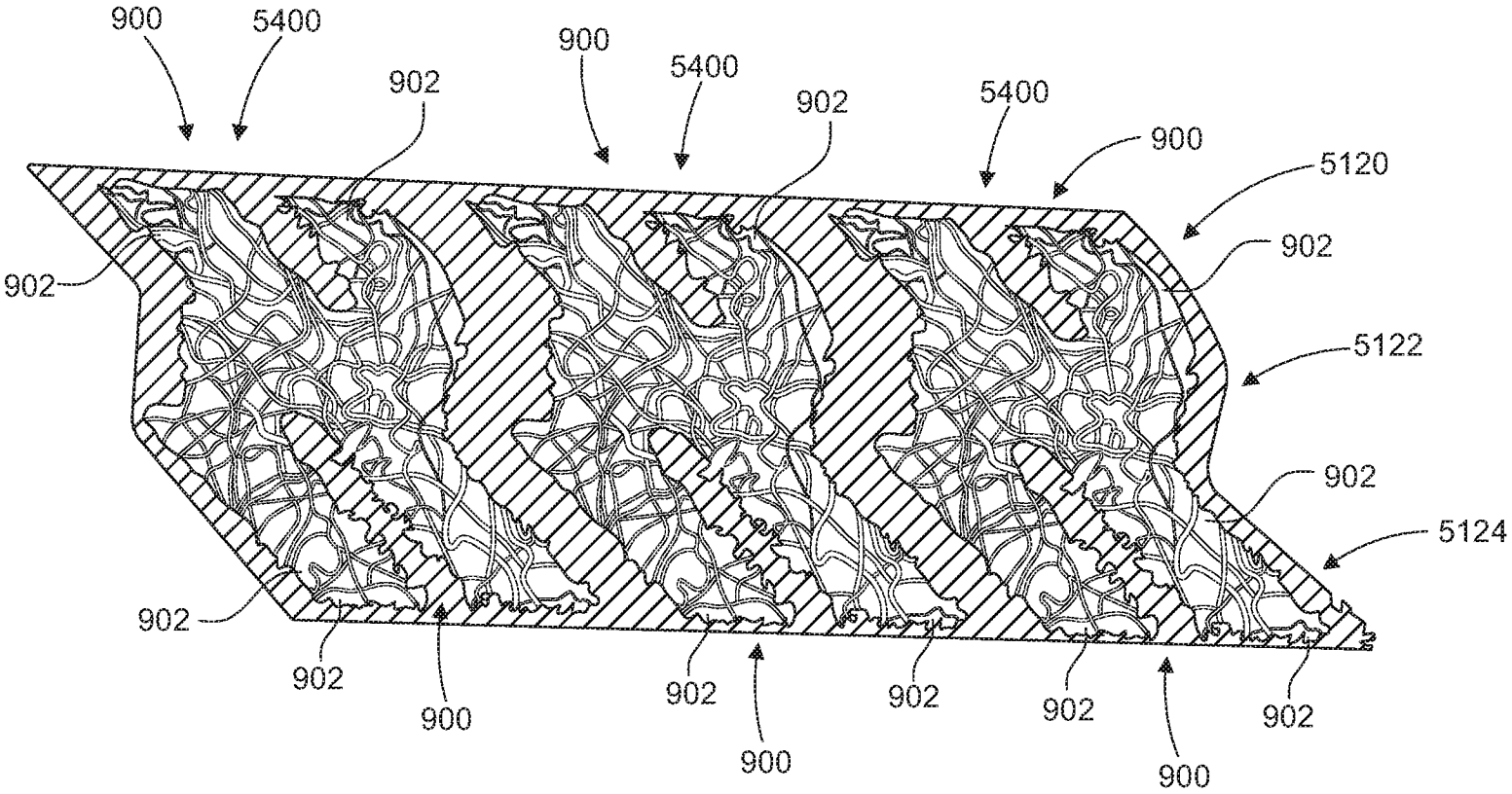

Prior art FIG. 2A corresponds to FIG. 1 of U.S. Pat. No. 4,212,692;

Prior art FIG. 2B corresponds to FIG. 2 of U.S. Pat. No. 4,212,692;

Prior art FIG. 2C corresponds to FIG. 3 of U.S. Pat. No. 4,212,692;

Prior art FIG. 2D corresponds to FIG. 4 of U.S. Pat. No. 4,212,692;

FIG. 3 is an end view of an exemplary embodiment of a ridge vent made from convoluted filaments;

FIG. 4 is a top perspective view of an exemplary matrix of convoluted filaments;

FIG. 5 is a bottom perspective view of an exemplary matrix of convoluted filaments;

FIG. 6A is a bottom perspective view of a spacing element of an exemplary matrix of convoluted filaments;

FIG. 6B is a top perspective view of a spacing element of an exemplary matrix of convoluted filaments;

FIG. 7A is a bottom perspective view of a spacing element of an exemplary matrix of convoluted filaments;

FIG. 7B is a top perspective view of a spacing element of an exemplary matrix of convoluted filaments;

FIG. 8 is a bottom perspective view of spacing elements of matrixes of convoluted filaments having different heights;

FIG. 9A is a top perspective view of a an exemplary matrix of convoluted filaments;

FIG. 9B is a bottom perspective view of a an exemplary matrix of convoluted filaments;

FIG. 10 is a schematic illustration of an exemplary configuration of a matrix of convoluted filaments;

FIG. 11A is a top view of an exemplary configuration of a matrix of convoluted filaments;

FIG. 11B is an end view of the matrix configuration illustrated by FIG. 11A;

FIG. 11C is a front view of the matrix configuration illustrated by FIG. 11A;

FIG. 12A is a top perspective view of one half of a ridge vent made from convoluted filaments in an unfolded state;

FIG. 12B illustrates a configuration of a portion of the vent illustrated by FIG. 12A;

FIG. 12C illustrates a configuration of portions of the vent illustrated by FIG. 12A;

FIG. 13 is a bottom perspective view of the ridge vent illustrated by FIG. 12A in an unfolded state;

FIG. 14A is an end view of the ridge vent illustrated by FIG. 12A in an unfolded state;

FIG. 14B illustrates a configuration of a portion of the vent illustrated by FIG. 14A;

FIG. 14C illustrates a configuration of portions of the vent illustrated by FIG. 12A;

FIG. 15A is a side perspective view of one half of a ridge vent made from convoluted filaments in a folded state;

FIG. 15B illustrates a configuration of a portion of the vent illustrated by FIG. 15A;

FIG. 15C illustrates a configuration of portions of the vent illustrated by FIG. 15A;

FIG. 16A is a top perspective view of one half of a ridge vent made from convoluted filaments in an unfolded state;

FIG. 16B illustrates a configuration of a portion of the vent illustrated by FIG. 16A;

FIG. 16C illustrates a configuration of a portion of the vent illustrated by FIG. 16A;

FIG. 16D illustrates a configuration of a portion of the vent illustrated by FIG. 16A;

FIG. 17A is a side perspective view of one half of a ridge vent made from convoluted filaments in a folded state;

FIG. 17B illustrates a configuration of a portion of the vent illustrated by FIG. 17A;

FIG. 17C illustrates a configuration of a portion of the vent illustrated by FIG. 17A;

FIG. 17D illustrates a configuration of a portion of the vent illustrated by FIG. 17D;

FIG. 18A illustrates a first layer of the matrix configuration illustrated by FIG. 11A positioned on top of a second layer of the matrix configuration illustrated by FIG. 11A;

FIG. 18B is an end view of the two layer matrix configuration illustrated by FIG. 18A;

FIG. 18C is a front view of the two layer matrix configuration illustrated by FIG. 18A;

FIG. 19A is a bottom perspective view of an exemplary matrix of convoluted filaments;

FIG. 19B is an end view of an exemplary matrix of convoluted filaments;

FIG. 20A is an end view of an exemplary embodiment of a ridge vent made from convoluted filaments having a filter;

FIG. 20B is an end view of an exemplary embodiment of a ridge vent made from convoluted filaments having a filter;

FIGS. 21-24 are views of an exemplary embodiment of a ridge vent made from convoluted filaments assembled with a filter material;

FIG. 25 is an end view of an exemplary embodiment of a ridge vent made from convoluted filaments having a filter;

FIG. 26 is an end view of an exemplary embodiment of a ridge vent made from convoluted filaments having a filter;

FIG. 27 is an end view of an exemplary embodiment of a ridge vent made from convoluted filaments having a filter;

FIG. 28 is an end view of an exemplary embodiment of a ridge vent made from convoluted filaments having a filter;

FIG. 29 is an end view of an exemplary embodiment of a ridge vent made from convoluted filaments having a filter;

FIG. 30 is an end view of an exemplary embodiment of a ridge vent made from convoluted filaments having a filter;

FIG. 31 is an end view of an exemplary embodiment of a ridge vent made from convoluted filaments having a filter in an unfolded condition;

FIG. 32 is an end view of the ridge vent illustrated by FIG. 31 in a folded condition;

FIG. 33 is an end view of an exemplary embodiment of a ridge vent made from convoluted filaments having a filter in an unfolded condition;

FIG. 34 is an end view of the ridge vent illustrated by FIG. 31 in a folded condition;

FIG. 35 is an end view of an exemplary embodiment of a ridge vent made from convoluted filaments having a filter in an unfolded condition;

FIG. 36 is an end view of the ridge vent illustrated by FIG. 31 in a folded condition;

FIG. 37 is an end view of an exemplary embodiment of a ridge vent made from convoluted filaments;

FIG. 38 is an end view of an exemplary embodiment of a ridge vent made from convoluted filaments;

FIG. 39 is an end view of an exemplary embodiment of a ridge vent made from convoluted filaments having a filter;

FIG. 40 is an end view of an exemplary embodiment of a ridge vent made from convoluted filaments having a filter;

FIG. 41 is an end view of an exemplary embodiment of a ridge vent made from convoluted filaments having a nailing channel;

FIG. 42 is an end view of an exemplary embodiment of a ridge vent made from convoluted filaments having a nailing channel;

FIG. 43 is an end view of an exemplary embodiment of a ridge vent made from convoluted filaments having a nailing channel and a filter;

FIG. 44 is an end view of an exemplary embodiment of a ridge vent made from convoluted filaments having a nailing channel and a filter;

FIG. 45 is an end view of an exemplary embodiment of a ridge vent made from convoluted filaments having a nailing reinforcement;

FIG. 46 is an end view of an exemplary embodiment of a ridge vent made from convoluted filaments having a nailing reinforcement;

FIG. 47 is an end view of an exemplary embodiment of a ridge vent made from convoluted filaments having a nailing reinforcement;

FIG. 48 is an end view of an exemplary embodiment of a ridge vent made from convoluted filaments having a hinge feature;

FIG. 49 is an end view of an exemplary embodiment of a ridge vent made from convoluted filaments having a hinge feature;

FIG. 50 is an end view of an exemplary embodiment of a ridge vent made from convoluted filaments having a hinge feature;

FIG. 51 is an end view of an exemplary embodiment of a ridge vent made from convoluted filaments having a filter in an unfolded condition;

FIG. 52 is an end view of the ridge vent illustrated by FIG. 31 in a folded condition;

FIG. 53 is a view of an exemplary embodiment of a ridge vent made from convoluted filaments assembled with a filter material;

FIGS. 54A-54C illustrate a spacing element of an exemplary matrix of convoluted filaments; and FIG. 55 illustrates an array of the spacing elements illustrated by FIGS. 54A-54C.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

FIG. 3 illustrates an exemplary embodiment of a ridge vent 300 made from one or more nets or matrixes 302 of convoluted filaments 304. In each of the exemplary embodiments disclosed by the present patent application, the ridge vent 300 is made from one or more sections of nets 302. Each of the nets 302 can be made in the same general manner disclosed by U.S. Pat. No. 4,212,692. In one exemplary embodiment, the filaments 304 are deposited on a flat portion of a continuous elongated belt. Also, the truncated pyramids 4 can be replaced with a wide variety of different shapes, some of which are described in more details below. The different shapes and spacing of the different shapes allows nets 302 having a wide variety of different configurations to be formed.

The convoluted filaments 304 can be made from a wide variety of different materials. Examples of suitable materials for the convoluted filaments 304 include, but are not limited to nylon, polypropylene, a mixture of asphalt and a plastic material, such as a mixture of asphalt and polypropylene and asphalt, such as a mixture of 10-15% asphalt with polypropylene, polyester, polyurethane, and/or any recycled plastic and/or asphalt material. Any material capable of being formed into convoluted filaments can be used.

Each of the nets or matrixes 302 disclosed by the present applications and the vents 300 or portions of the vents disclosed by the present application can be used in a wide variety of applications other than roof vents. For example, the nets or matrixes 302 disclosed by the present applications and the vents 300 or portions of the vents disclosed by the present application can be used as vents for non-roofing applications, vents used on roofs, but not at the roof ridge, noise separators, drainage systems, geo membranes, slot drains, gutter drains, etc.

The ridge vents 300 disclosed by the present application can be installed on a roof ridge in a wide variety of different ways. In one exemplary embodiment, the ridge vents 300 are installed in the manner disclosed by U.S. Pat. No. 4,962,699. However, any installation method can be employed.

In the exemplary embodiment illustrated by FIG. 3, the ridge vent 300 includes a thick, single layer center section 306 and two, double layer outer sections 308. In the illustrated embodiment, the thickness T of the center section 306 is the same or about the same as the thicknesses of the two end sections 308. In the illustrated embodiment, each of the end sections 308 includes a top net layer 310 and a bottom net layer 312. In the illustrated embodiment, the thicknesses $T_T$, $T_B$ of the top and bottom layers 310, 312 are each one half the thickness of the thickness T of the center section. However, in other embodiments, the top and bottom layers may have different thicknesses, which when stacked on top of one another, may or may not equal the thickness of the center section 306. In on one exemplary embodiment, the top net layer 310 or the bottom net layer 312 is integrally formed with the center net section 306. The top or bottom net layer that is not integrally formed with the center net section 306 is connected to the center net section 306 and the layer 310 or 312 that is integrally formed with the center net section 306. In another exemplary embodiment, the top net layer 310, the bottom net layer 312, and the center net section 306 are all separately formed and assembled together.

In one exemplary embodiment, the densities of the center section 306 is less than the density of the end sections 308. For example, the density of filaments 304 of each end section 308 may be twice the density of the filaments 304 of the center section 306. This may be accomplished in a variety of different ways. For example, when the molten filaments 5 may be deposited to make the center section 306 having the height T, at the same rate that the filaments 5 are deposited to make the top end web layer 310 having the thickness $T_T$, and at the same rate that the filaments 5 are deposited to make the bottom end web layer 312 having the thickness $T_B$. If the thicknesses $T_T$, $T_B$ are each ½ the thickness T, the density of filaments 304 of each of the end sections 308 will be twice the density of filaments 304 of the center section 306. Similarly, if the thicknesses $T_T$, $T_B$ add up to the thickness T, the density of filaments 304 of each of the end sections 308 will be twice the density of filaments 304 of the center section 306.

FIGS. 4 and 5 illustrate an exemplary embodiment of a net 302 of convoluted filaments 304 having a configuration that may be use in the center section 306 and/or the end sections 308. The net illustrated by FIGS. 4 and 5 has a planar bottom surface 400 formed from the convoluted filaments 304 with upwardly extending spacing elements 402 also formed from the convoluted filaments. FIGS. 6A and 6B illustrate an individual spacing element 402 with a planar base portion 404. The planar base portions 404 are connected to other planar base portions 404 as the convoluted filaments are deposited to form the net 302 illustrated by FIGS. 4 and 5.

FIGS. 7A and 7B illustrate another example of individual spacing element 702 with planar base portions 704. The planar base portions 704 are connected to other planar base portions 704 to form a net 302. Referring to FIG. 8, the height $H_1$ of the spacing element 402 may be about twice the height $H_2$ of the spacing element 702. As such, the spacing elements 402 and base portions 404 may be used to construct the center section 306 of a vent 300 and the spacing elements 702 and base portions 704 may be used to construct the top and bottom layers 310, 312 of the end sections 308.

When the molten filaments 5 are deposited to make the spacing elements 402 and base portions 404 having the height $H_1$, at the same rate that the filaments 5 are deposited to make the spacing elements 702 and base portions 704, the density of filaments 304 of the spacing elements 702 and base portions 704 will be twice the density of filaments 304 of the spacing elements 402 and base portions 404.

FIGS. 9A and 9B illustrate an exemplary embodiment of a net 302 of convoluted filaments 304 having a configuration that may be use in the center section 306 and/or the end sections 308. FIG. 10 illustrates the shape of the net 302 illustrated by FIGS. 9A and 9B, without showing the filaments 304 to simplify the drawing. The net illustrated by FIGS. 9A, 9B and 10 has a undulating rows 900 with peaks 902 and valleys 904. The undulating rows 900 can have a wide variety of different configurations. The rows 900 can extend in the direction of the length L of the vent 300, in the direction of the width W of the vent, or at an angle to the directions of the length L and width W of the vent 300. In the example illustrated by FIGS. 11A, 11B, and 11C, the rows extend at an angle to the directions of the length L and the width W of the vent 300. For example, the rows 900 may extend at an angle of between 30 and 60 degrees to the length or width of the vent, such as 45 degrees to the directions of the length and width of the vent.

FIGS. 19A and 19B illustrate an exemplary embodiment of a net 302 of convoluted filaments 304 having a configuration that may be use in the center section 306 and/or the end sections 308. The net illustrated by FIGS. 19A and 19B has a undulating rows 1900 (one illustrated) with a flat or planar top portion 1902 and curved valleys 1904. In another exemplary embodiment, the valleys can be flat and the peaks or top portions can be curved. The undulating rows 1900 can have a wide variety of different configurations. The rows 1900 can extend in the direction of the length L of the vent 300, in the direction of the width W of the vent, or at an angle to the directions of the length L and width W of the vent 300. FIGS. 19A and 19B illustrate an individual row 1900 with the flat or planar top portion 1902. The flat or planar top portions 1902 are connected by the convoluted filaments 304 that form the net.

FIGS. 12A and 13 are top and bottom perspective views of one half of a ridge vent 300 made from convoluted filaments 304 in an unfolded state. FIG. 14A is an end view of the unfolded ridge vent shown in FIGS. 12A and 12B. FIG. 15 illustrates the ridge vent shown in FIGS. 12A, 13, and 14A in a folded state. The illustrated ridge vent has a center section 306 and an end section 308 made from top layer 310 that will be folded onto a bottom layer 312. FIGS. 12B, 14B, and 15B illustrate the material of the top layer 310. FIGS. 12C, 14C, and 15C illustrate the material of the bottom layer 312 and the center section 306. The thickness T of the center section 306 is the same or about the same as the thickness of the end sections 308 (See FIG. 15A). The illustrated vent 300 can be used in the illustrated orientation or the vent can be flipped over and used upside down.

In the embodiment illustrated by FIGS. 12A, 13, 14A, and 15A, the thicknesses $T_T$, $T_B$ of the top and bottom layers 310, 312 are each one half the thickness of the thickness T of the center section. In the illustrated embodiment, the bottom net layer 312 is integrally formed with the center net section 306 and the top net layer 310 is integrally formed with the bottom net layer 312. In an exemplary embodiment, the top net layer 310 is connected to the bottom net layer with a thin layer 1200 of filaments 304 that acts as a hinge. In the illustrated embodiment, the density of filaments 304 of the end section 308 is about twice the density of the filaments 304 of the center section 306.

In the embodiment illustrated by FIGS. 12A, 13, 14A, and 15A, the center section 306 comprises convoluted filaments 304 has a planar bottom surface 400 formed from the convoluted filaments 304 with upwardly extending spacing elements 402. FIG. 14C illustrates an individual spacing element 402 with a planar base portions 404. The planar base portions 404 are connected to other planar base portions 404 to form the center section 306.

In the embodiment illustrated by FIGS. 12A, 13, 14A, and 15A, the bottom net layer 312 comprises individual spacing elements 702 with planar base portions 704. The planar base portions 704 are connected to other planar base portions 704 to form the bottom net layer 312. The height $H_1$ of the spacing element 402 may be about twice the height $H_2$ of the spacing element 702.

In the embodiment illustrated by FIGS. 12A, 13, 14A, and 15A, the top net layer 310 comprises has a undulating rows 900 with peaks 902 and valleys 904. The rows 900 extend at an angle to the directions of the length L and width W of the vent 300. For example, the rows 900 may extend at an angle of between 30 and 60 degrees to the length or width of the vent, such as 45 degrees to the directions of the length and width of the vent.

Referring to FIG. 15A, the spacing elements 702 engage the undulating rows 900 when the vent 300 is in the folded state. This folded state is the finished state of the vent 300 that will be installed on the roof. The spacing elements 702 support the rows 900. The density of convoluted filaments 304 of the folded end section 308 is about twice the density of the center section 306 as described above. The engagement between the spacing elements 702 with the undulating rows 900 and the higher density of the end section 308 makes the end section 308 stronger than the center section 306. This increased strength makes the end sections 308 less likely to be crushed in the event that they are stepped on by an installer or other person working on the roof. The increased strength of the double density folded end section supports the cap shingles in shingle in the area where the cap shingle is nailed. This support makes it less likely that the vent 300 will be compressed by the nail or minimizes compression of the vent by the nail.

FIG. 16A is a top perspective view of one half of a ridge vent 300 made from convoluted filaments 304 in an unfolded state. FIG. 17A illustrates the ridge vent shown in FIG. 16A in a folded state. The illustrated ridge vent has a center section 306 and an end section 308 made from top layer 310 that will be folded onto a bottom layer 312. FIGS. 16B and 17B illustrate the material of the top layer 310. FIGS. 16C and 17C illustrate the material of the bottom layer 312. FIGS. 16D and 17D illustrate the material of the center section 306. The thickness T of the center section 306 is the same or about the same as the thickness of the end sections 308 (See FIG. 17A). The illustrated vent 300 can be used in the illustrated orientation or the vent can be flipped over and used upside down.

In the embodiment illustrated by FIGS. 16A and 17A, the thicknesses $T_T$, $T_B$ of the top and bottom layers 310, 312 are each one half the thickness of the thickness T of the center section. In the illustrated embodiment, the bottom net layer 312 is integrally formed with the center net section 306 and the top net layer 310 is integrally formed with the bottom net layer. In an exemplary embodiment, the top net layer 310 is connected to the bottom net layer with a thin layer 1200 of filaments 304 that acts as a hinge. In the illustrated embodiment, the density of filaments 304 of the end section 308 is about twice the density of the filaments 304 of the center section 306.

In the embodiment illustrated by FIGS. 16A and 17A, the center section 306 comprises convoluted filaments 304 has a planar bottom surface 400 formed from the convoluted filaments 304 with upwardly extending spacing elements 402. FIGS. 16D and 17D illustrate an individual spacing element 402 with a planar base portions 404. The planar base portions 404 are connected to other planar base portions 404 to form the center section 306.

In the embodiment illustrated by FIGS. 16A and 17A, both the top and bottom net layers 310, 312 comprise undulating rows 900 with peaks 902 and valleys 904. The rows 900 extend at an angle to the directions of the length L and width W of the vent 300. For example, the rows 900 may extend at an angle of between 30 and 60 degrees to the length or width of the vent, such as 45 degrees to the directions of the length and width of the vent.

Referring to FIGS. 17A and 18A-18C, undulating rows 900 of the top layer 310 engage the undulating rows 900 of the bottom layer 312 when the vent 300 is in the folded state. This folded state is the finished state of the vent 300 that will be installed on the roof. Since the undulating rows 900 are at an angle with respect to the length L and width W of the vent 300, the undulating rows 900 engage one another in a crossing pattern when the top layer 310 is folded onto the bottom layer 312 (See FIG. 18A). The density of convoluted filaments 304 of the folded end section 308 is about twice the density of the center section 306 as described above. The crossing pattern of the undulating rows 900 and the higher density of the end section 308 makes the end section 308 stronger than the center section 306. This increased strength makes the end sections 308 less likely to be crushed in the event that they are stepped on by an installer or other person working on the roof.

FIG. 20A illustrates an exemplary embodiment of a vent 300 that includes a filter 2000. The filter can take a wide variety of different forms and can be used on a wide variety of different vent configurations. In the example illustrated by FIG. 20A, the vent 300 comprises a single layer 2002 of a net 302 of convoluted filaments 304. Any of the nets 302 can have any of the configurations described herein. In the illustrated embodiment, the filter 2000 completely covers a top surface 350, completely covers the side surfaces 352, and extends inward on the bottom surface 354 of the vent. Covering the side surfaces 352 with the filter 2000 inhibits dirt, dust, debris, insects, and/or wind driven rain from entering the vent. The configuration illustrated by FIG. 20A allows the filter 2000 to be connected to the top surface 350 and/or the bottom surface 354, but optionally not the side surfaces 352. By not connecting (i.e. by heat bonding or adhesive) the filter 2000 to the side surfaces 352, potential leak paths through the side of the vent are avoided.

The filters 2000 disclosed by the present application can take a wide variety of different forms. For example, the filter material can be fibrous, woven, or non-woven material. The filter material can be point bond, spun bond, or air laid. The filter 2000 can be made from a variety of different materials. Examples of suitable materials include, but are not limited to, nylon, polypropylene, a mixture of asphalt and a plastic material, such as a mixture of asphalt and polypropylene and asphalt, such as a mixture of 10-15% asphalt with polypropylene, polyester, polyurethane, and/or any recycled plastic and/or asphalt material. Any material capable of being formed into filter fabric or sheet can be used.

FIG. 20B illustrates another exemplary embodiment of a vent 300 that includes a filter 2000. In the example illustrated by FIG. 20B, the vent 300 has the configuration shown in FIG. 3. In the illustrated embodiment, the filter 2000 completely covers a top surface 350, completely covers the side surfaces 352, and extends inward on the bottom surface 354 of the vent. In another exemplary embodiment, the vent 300 illustrated by FIG. 20B is flipped over, so that the filter 2000 completely covers the bottom surface 354, completely covers the side surfaces 352, and extends inward on the top surface 350 of the vent. The filter 200 may be bonded, for example, by heat lamination or with an adhesive, to one or more of the flat surfaces and/or apexes of the matrixes 302 to secure the filter to the vent 300.

FIGS. 21-24 are views of an exemplary embodiment of a ridge vent made from convoluted filaments assembled with a filter material 2000. The embodiment of FIGS. 21-24 illustrates that filter material over the side surfaces 352 can be omitted for applications where filtering is not required. In the illustrated embodiment, the a filter material portion 2102 extends across the center section 306 and is attached to the end sections 308. In an exemplary embodiment, this configuration keeps the end sections 308 in a folded/assembled condition. An optional filter material portion 2104 can also be included on the top surface 350. In one exemplary embodiment, the filter material portion 2102 or 2104 is positioned against the slot in the ridge of the roof to provide the filtering function without covering the side surfaces 352 of the vent 300. When both filter material portions 2102 and 2104 are included and the filter function is needed, the vent can be positioned with either filter material portion 2102 or 2104 against the slot in the ridge of the roof.

FIGS. 25 and 26 illustrate exemplary embodiments of ridge vents 300 that are similar to the ridge vents illustrated by FIGS. 20A and 20B. Like the FIGS. 20A and 20B embodiments, in the FIGS. 25 and 26 embodiments, the filter 2000 completely covers the top surface 350, completely covers the side surfaces 352, and extends inward on the bottom surface 354 of the vent. However, the portions 2500 of the filter material that covers the side surfaces 352 are spaced apart from the side surfaces 352 or there is slack in filter material at the side surfaces. This spacing or slack at the side surfaces improves the net free vent area of the vent, since the filter material is not pressed up against the side surfaces 352. The embodiment illustrated by FIG. 27 is similar to the embodiments illustrated by FIGS. 25 and 26, except the vent has the folded configuration of FIGS. 31 and 32, which is described below.

FIGS. 28-30 illustrate exemplary embodiments of ridge vents that are similar to the embodiments illustrated by FIGS. 25-27. In the exemplary embodiments illustrated by FIGS. 28-30, the side surfaces 352 include concavities 2800 or indentations. In the illustrated embodiment, the filter 2000 completely covers the top surface 350, completely covers the side surfaces 352, and extends inward on the bottom surface 354 of the vent. However, indentations 2800 space the filter material 2000 apart from the side surfaces 352. As in the embodiments illustrated by FIGS. 25-27, this spacing improves the net free vent area of the vent, since the filter material is not pressed up against the side surfaces 352. However, the embodiment illustrated by FIGS. 28-30 allows the filter 2000 to be tightly wrapped around the vent.

FIGS. 31 and 32 illustrate an exemplary embodiment of a vent 300 that is made by providing several sections of connected net sections 302 and then folding the sections. The sections 302 can be connected together by filter material 2000 or by convoluted filaments 304 that form the net sections 302. In one exemplary embodiment, all of the sections are concurrently formed by extruding convoluted filaments 304 onto a tool, such as an endless belt, that defines the configuration of all of the sections. For example, the tool defines the height, width, and shape of the protrusions and flat surfaces of each of the sections. In the illustrated exemplary embodiment, the vent includes a center section 306 and two end sections 308. The end sections 308 each include a top end section layer 310, an edge defining portion 3100, and a bottom end section layer 312. In the illustrated embodiment, an optional filter 2000 is attached to the center section 306, the top end section layers 310, the edge defining portions 3100, and the bottom end section layers 312. The vent is folded from the configuration illustrated by FIG. 31 to the configuration illustrated by FIG. 32 and the bottom end section layers 312 are attached to the center section 306 to complete the vent for assembly on the roof ridge. For example, the bottom end section layers 312 may be attached to the center section 306 by attaching the filter material 2000 to the center section 306, by an adhesive, or by thermal bonding.

FIGS. 33 and 34 illustrate an exemplary embodiment of a vent 300 that is made by providing several sections of connected net sections 302 and then moving some of the sections on top of other sections to complete the vent. The sections 302 can be connected together by filter material 2000 and/or by convoluted filaments 304 that form the net sections 302. In one exemplary embodiment, all of the sections are concurrently formed by extruding convoluted filaments 304 onto a tool, such as an endless belt, that defines the configuration of all of the sections. In the illustrated exemplary embodiment, the vent includes a center section 306 and two end sections 308. The end sections 308 each include a top end section layer 310, and a bottom end section layer 312. In the illustrated embodiment, an optional filter 2000 is attached to the center section 306, the top end section layers 310, and the bottom end section layers 312. The bottom end section layers 312 and the filter 2000 are moved from the configuration illustrated by FIG. 33 to the configuration illustrated by FIG. 34. Portions 3300 of the filter material 2000 are tucked between the top and bottom end section layers 310, 312. Ends 3302 of filter material 2000 are attached to the center section 306 to complete the vent for assembly on the roof ridge. The bottom end section layers 312 may alternatively be attached to the center section 306 by an adhesive, or by thermal bonding.

FIGS. 35 and 36 illustrate an exemplary embodiment of a vent 300 that is made by providing several sections of connected net sections 302 and then folding the sections. The sections 302 can be connected together by filter material 2000 or by convoluted filaments 304 that form the net sections 302. In one exemplary embodiment, all of the sections are concurrently formed by extruding convoluted filaments 304 onto a tool, such as an endless belt, that defines the configuration of all of the sections. In the illustrated exemplary embodiment, the vent includes a center section 306 and two end sections 308. The end sections 308 each include a top end section layer 310, and a bottom end section layer 312. In the illustrated embodiment, an optional filter 2000 is attached to the center section 306, the top end section layers 310, and the bottom end section layers 312. The vent is folded from the configuration illustrated by FIG. 35 to the configuration illustrated by FIG. 36. The portions 3500 of filter material wrap around the side surfaces and the bottom end section layers 312. The bottom end section layers are attached to the center section 306 to complete the vent for assembly on the roof ridge. For example, the bottom end section layers 312 may be attached to the center section 306 by attaching the filter material 2000 to the center section 306, by an adhesive, or by thermal bonding.

FIGS. 51 and 52 illustrate an exemplary embodiment of a vent 300 that is made by providing several sections of connected net sections 302 and then folding the sections. The sections 302 can be connected together by filter material 2000 and/or by convoluted filaments 304 that form the net sections 302. In one exemplary embodiment, all of the sections are concurrently formed by extruding convoluted filaments 304 onto a tool, such as an endless belt, that defines the configuration of all of the sections. For example, the tool defines the height, width, and shape of the protrusions and flat surfaces of each of the sections.

In the illustrated exemplary embodiment, the vent includes a center section 306 and two end sections 308. The end sections 308 each include a first top end section portion 5110, a substantially flat dense portion 5112, a second top end section portion 5114, a concavity forming portion 5116, a first bottom end section portion 5120, a support portion 5122, a second bottom end section portion 5124, and a flat connection portion 5128. In the illustrated embodiment, an optional filter 2000 is attached to the first top end section portion 5110, the substantially flat dense portion 5112, the second top end section portion 5114, the concavity forming portion 5116, the first bottom end section portion 5120, the support portion 5122, the second bottom end section portion 5124, and the flat connection portion 5128.

The first top end section portion 5110 can take a wide variety of different forms. The first top end section portion 5110 can be a net 302 of convoluted filaments 304 having any of the configurations described in the present application. In one exemplary embodiment, the first top end section portion 5110 has the row configuration illustrated by FIGS. 9A, 9B, 10, 11A, 11B, and 11C. In the embodiment illustrated by FIG. 51, the first top end section portion 5110 has a thickness that is ½ the thickness of the center section 306. However, in other exemplary embodiments, the top end section portion 5110 may have a different thickness.

The substantially flat dense portion 5112 can take a wide variety of different forms. In an exemplary embodiment, a flat net 302 of convoluted filaments 304 is formed. For example, the convoluted filaments 304 can be dispensed onto a flat surface to form the flat dense portion 5112. In another exemplary embodiment, the flat dense portion 5112 can be a separate material that bridges the gap between the first top end section portion 5110 and the second top end section portion 5114. In an exemplary embodiment, the flat dense portion 5112 is strong enough to prevent a roofing nail applied directly to the flat dense portion 5112 with a roofing nail gun from penetrating completely through the flat dense portion 5112. That is, the flat dense portion 5112 catches the head of a standard roofing nail applied with a standard roofing nail gun.

The second top end section portion 5114 can take a wide variety of different forms. The second top end section portion 5114 can be a net 302 of convoluted filaments 304 having any of the configurations described in the present application. In one exemplary embodiment, the second top end section portion 5114 has the row configuration illustrated by FIGS. 9A, 9B, 10, 11A, 11B, and 11C. In the embodiment illustrated by FIG. 51, the second top end section portion 5114 has a thickness that is ½ the thickness of the center section 306. However, in other exemplary embodiments, the second top end section portion 5114 may have a different thickness.

The concavity forming portion 5116 can take a wide variety of different forms. In an exemplary embodiment, a thin net 302 of convoluted filaments 304 is formed in a concave configuration. For example, the convoluted filaments 304 can be dispensed onto an elongated, curved surface to form the flat concavity forming portion 5116.

The first bottom end section portion 5120 can take a wide variety of different forms. The first bottom end section portion 5120 can be a net 302 of convoluted filaments 304 having any of the configurations described in the present application. In one exemplary embodiment, the first bottom end section portion 5110 has the row configuration illustrated by FIGS. 9A, 9B, 10, 11A, 11B, and 11C. In an exemplary embodiment, rows of the first bottom end section portion 5120 are disposed at an angle with respect to rows of the first top end section portion 5110 (See for example, FIG. 18A). In the embodiment illustrated by FIG. 51, the first bottom end section portion 5120 has a thickness that is ½ the thickness of the center section 306. However, in other exemplary embodiments, the first bottom end section portion 5120 may have a different thickness.

The support portion 5122 can take a wide variety of different forms. The support portion 5122 can be a net 302 of convoluted filaments 304 having any of the configurations described in the present application. In one exemplary embodiment, the support portion 5122 has the single row configuration illustrated by FIGS. 19A and 19B. In the embodiment illustrated by FIG. 51, support portion 5122 has a thickness that is about the same as the thickness of the center section 306. However, in other exemplary embodiments, the support portion 5122 may have a different thickness, such as the thickness of the center section 306 minus the thickness of the substantially flat dense portion 5112.

The second bottom end section portion 5124 can take a wide variety of different forms. The second bottom end section portion 5124 can be a net 302 of convoluted filaments 304 having any of the configurations described in the present application. In one exemplary embodiment, the second bottom end section portion 5124 has the row configuration illustrated by FIGS. 9A, 9B, 10, 11A, 11B, and 11C. In an exemplary embodiment, rows of the second bottom end section portion 5124 are disposed at an angle with respect to rows of the second top end section portion 5114 (See for example, FIG. 18A). In the embodiment illustrated by FIG. 51, the second bottom end section portion 5124 has a thickness that is ½ the thickness of the center section 306. However, in other exemplary embodiments, the second bottom end section portion 5124 may have a different thickness.

FIGS. 54A-54C, and 55 illustrate another exemplary embodiment of a configuration of the first bottom end section portion 5120, the support portion 5122, and the second bottom end section portion 5124. In the example illustrated by FIGS. 54A-54C, and 55 the first bottom end section portion 5120, the support portion 5122, and the second bottom end section portion 5124 are contiguously formed repeating units 5400. The first bottom end section portion 5120 and the second bottom end section portion 5122 of each unit 5400 each comprises two rows 900 with peaks 902 (See, for example, FIGS. 9A, 9B, 10, 11A, 11B, and 11C). The first and second bottom end section portions 5120, 5124 of each unit 5400 has a thickness or height that is ½ the thickness of the support portion 5122. However, in other exemplary embodiments, first and second bottom end section portions 5120, 5124 of each unit 5400 may have a different thickness. The support portion 5122 extends between the first bottom end section portion 5120 and the second bottom end section portion 5122 of each unit 5400. The support portion 5120 of each unit 5400 is mounded in a manner similar to the configurations illustrated by FIGS. 7A and 7B. The repeating units 5400 are nested as illustrated by FIG. 55 along the length of the vent 300 on each side of the vent.

The flat connection portion 5128 can take a wide variety of different forms. In an exemplary embodiment, a flat net 302 of convoluted filaments 304 is formed. For example, the convoluted filaments 304 can be dispensed onto a flat surface to form flat connection portion 5128. In another exemplary embodiment, the flat connection portion 5128 can be a separate material that extends from the first bottom end section portion 5120. In an exemplary embodiment, the flat connection portion 5128 can be heat bonded to the center section 306.

The center section 306 of the embodiment illustrated by FIG. 51 can take a wide variety of different forms. The center section 306 can be a net 302 of convoluted filaments 304 having any of the configurations described in the present application. In one exemplary embodiment, the center section 306 has the configuration illustrated by FIGS. 4, 5, 6A, and 6B. In the embodiment illustrated by FIG. 51, the center section 306 may have a hinge 4800. For example, the hinge 4800 may have any of the configurations illustrated by FIGS. 48-50. However, any hinge configuration can be implemented.

The vent is folded from the configuration illustrated by FIG. 51 to the configuration illustrated by FIG. 52. In the folded configuration, the first bottom end section portion 5120 abuts the first top end section portion 5110, the support portion 5122 abuts the substantially flat dense portion 5112, and the second bottom end section portion 5124 abuts the second top end section portion 5114. The concavity forming portions 5116 form the side surfaces 352 of the vent. The flat connection portions 5128 are attached to the center section 306 to complete the vent for assembly on the roof ridge. In an exemplary embodiment, the flat connection portions 5128 are heat bonded to the center section.

The combined height of the first bottom end section portion 5120 and the first top end section portion 5110 is equal to the height of the center section 306 in the illustrated embodiment. The support portion 5122 supports the substantially flat dense portion 5112 at the height of the center section 306 in the illustrated embodiment. The combined height of the second bottom end section portion 5124 and the second top end section portion 5114 is equal to the height of the center section 306 in the illustrated embodiment. The concavity forming portions 5116 form the side surfaces 352 of the vent with concavities 2800 or indentations. In the illustrated embodiment, the filter 2000 completely covers the top surface 350, completely covers the side surfaces 352, and extends inward on the bottom surface 354 of the vent. However, indentations 2800 space the filter material 2000 apart from the side surfaces 352. This spacing improves the net free vent area of the vent, since the filter material is not pressed up against the side surfaces 352 and allows the filter 2000 to be tightly wrapped around the vent.

In one exemplary embodiment, the first top end section portion 5110, the substantially flat dense portion 5112, the second top end section portion 5114, the concavity forming portion 5116, the first bottom end section portion 5120, the support portion 5122, the second bottom end section portion 5124 are configured such that when the vent is folded from the configuration illustrated by FIG. 51 to the configuration illustrated by FIG. 52, the side surfaces 352 are tapered (See FIGS. 37-40). In another exemplary embodiment, the first top end section portion 5110, the substantially flat dense portion 5112, the second top end section portion 5114, the concavity forming portion 5116, the first bottom end section portion 5120, the support portion 5122, the second bottom end section portion 5124 are configured such that when the vent is folded from the configuration illustrated by FIG. 51 to the configuration illustrated by FIG. 52, the side surfaces 352 are vertical.

FIG. 53 illustrates an exemplary embodiment of a vent 300 that is made by providing several sections of connected net sections 302 and then folding the sections. The sections 302 can be connected together by filter material 2000 and/or by convoluted filaments 304 that form the net sections 302. In one exemplary embodiment, all of the sections are concurrently formed by extruding convoluted filaments 304 onto a tool, such as an endless belt, that defines the configuration of all of the sections. For example, the tool defines the height, width, and shape of the protrusions and flat surfaces of each of the sections.

In the illustrated exemplary embodiment illustrated by FIG. 53, the vent includes a center section 306 and two end sections 308. The end sections 308 each include a first top end section portion 5110, a substantially flat dense portion 5112, a second top end section portion 5114, a concavity forming portion 5116, a first bottom end section portion 5120, a support portion 5122, a second bottom end section portion 5124, and a flat connection portion 5128. In the illustrated embodiment, an optional filter 2000 is attached to the first top end section portion 5110, the substantially flat dense portion 5112, the second top end section portion 5114, the concavity forming portion 5116, the first bottom end section portion 5120, the support portion 5122, the second bottom end section portion 5124, and the flat connection portion 5128.

The first top end section portion 5110 can take a wide variety of different forms. The first top end section portion 5110 can be a net 302 of convoluted filaments 304 having any of the configurations described in the present application. In one exemplary embodiment, the first top end section portion 5110 has rows 900 with peaks 902 and valleys 904 (See, for example, FIGS. 9A, 9B, 10, 11A, 11B, and 11C). In the embodiment illustrated by FIG. 53, the first top end section portion 5110 has a thickness that is ½ the thickness of the center section 306. However, in other exemplary embodiments, the top end section portion 5110 may have a different thickness.

The substantially flat dense portion 5112 can take a wide variety of different forms. In an exemplary embodiment, a flat net 302 of convoluted filaments 304 is formed. For example, the convoluted filaments 304 can be dispensed onto a flat surface to form the flat dense portion 5112. In another exemplary embodiment, the flat dense portion 5112 can be a separate material that bridges the gap between the first top end section portion 5110 and the second top end section portion 5114. In an exemplary embodiment, the flat dense portion 5112 is strong enough to prevent a roofing nail applied directly to the flat dense portion 5112 with a roofing nail gun from penetrating completely through the flat dense portion 5112. That is, the flat dense portion 5112 catches the head of a standard roofing nail applied with a standard roofing nail gun.

The second top end section portion 5114 can take a wide variety of different forms. The second top end section portion 5114 can be a net 302 of convoluted filaments 304 having any of the configurations described in the present application. In one exemplary embodiment, the second top end section portion 5114 has rows 900 with peaks 902 and valleys 904 (See, for example, FIGS. 9A, 9B, 10, 11A, 11B, and 11C). In the embodiment illustrated by FIG. 51, the second top end section portion 5114 has a thickness that is ½ the thickness of the center section 306. However, in other exemplary embodiments, the second top end section portion 5114 may have a different thickness.

The concavity forming portion 5116 can take a wide variety of different forms. In an exemplary embodiment, a thin net 302 of convoluted filaments 304 is formed in a concave configuration. For example, the convoluted filaments 304 can be dispensed onto an elongated, curved surface to form the flat concavity forming portion 5116.

The first bottom end section portion 5120 can take a wide variety of different forms. The first bottom end section portion 5120 can be a net 302 of convoluted filaments 304 having any of the configurations described in the present application. In one exemplary embodiment, the first bottom end section portion 5110 has rows 900 with peaks 902 and valleys 904 (See, for example, FIGS. 9A, 9B, 10, 11A, 11B, and 11C). In an exemplary embodiment, rows 900 of the first bottom end section portion 5120 are disposed at an angle with respect to rows 900 of the first top end section portion 5110 (See for example, FIG. 18A). In the embodiment illustrated by FIG. 53, the first bottom end section portion 5120 has a thickness that is ½ the thickness of the center section 306. However, in other exemplary embodiments, the first bottom end section portion 5120 may have a different thickness.

The support portion 5122 can take a wide variety of different forms. The support portion 5122 can be a net 302 of convoluted filaments 304 having any of the configurations described in the present application. In one exemplary embodiment, the support portion 5122 has the single row 1900 configuration illustrated by FIGS. 19A and 19B. In the embodiment illustrated by FIG. 53, support portion 5122 has a thickness that is about the same as the thickness of the center section 306. However, in other exemplary embodiments, the support portion 5122 may have a different thickness, such as the thickness of the center section 306 minus the thickness of the substantially flat dense portion 5112.

The second bottom end section portion 5124 can take a wide variety of different forms. The second bottom end section portion 5124 can be a net 302 of convoluted filaments 304 having any of the configurations described in the present application. In one exemplary embodiment, the second bottom end section portion 5124 has rows 900 with peaks 902 and valleys 904 (See, for example, FIGS. 9A, 9B, 10, 11A, 11B, and 11C). In an exemplary embodiment, rows 900 of the second bottom end section portion 5124 are disposed at an angle with respect to rows 900 of the second top end section portion 5114 (See for example, FIG. 18A). In the embodiment illustrated by FIG. 51, the second bottom end section portion 5124 has a thickness that is ½ the thickness of the center section 306. However, in other exemplary embodiments, the second bottom end section portion 5124 may have a different thickness.

The flat connection portion 5128 can take a wide variety of different forms. In an exemplary embodiment, a flat net 302 of convoluted filaments 304 is formed. For example, the convoluted filaments 304 can be dispensed onto a flat surface to form flat connection portion 5128. In another exemplary embodiment, the flat connection portion 5128 can be a separate material that extends from the first bottom end section portion 5120. In an exemplary embodiment, the flat connection portion 5128 can be heat bonded to the center section 306 to hold the vent in the folded configuration.

The center section 306 of the embodiment illustrated by FIG. 53 can take a wide variety of different forms. The center section 306 can be a net 302 of convoluted filaments 304 having any of the configurations described in the present application. In one exemplary embodiment, the center section 306 has shorter spacing elements 702 in a middle portion of the vent 300 and taller spacing elements 402 on either side of the shorter spacing elements (See, for example, FIGS. 4, 5, 6A, and 6B). This configuration of shorter and taller spacing elements may provide the function of a hinge 4800.

The vent is folded to the configuration illustrated by FIG. 53. In the folded configuration, the first bottom end section portion 5120 abuts the first top end section portion 5110, the support portion 5122 abuts the substantially flat dense portion 5112, and the second bottom end section portion 5124 abuts the second top end section portion 5114. The concavity forming portion 5116 forms the side surfaces 352 of the vent. The flat connection portions 5128 are attached to the center section 306 to complete the vent for assembly on the roof ridge.

The combined height of the first bottom end section portion 5120 and the first top end section portion 5110 is equal to the height of the center section 306 in the illustrated embodiment. The rows 900 of illustrated first bottom end section portion 5120 and the first top end section portion 5110 cross at an angle. The support portion 5122 supports the substantially flat dense portion 5112 at the height of the center section 306 in the illustrated embodiment. The combined height of the second bottom end section portion 5124 and the second top end section portion 5114 is equal to the height of the center section 306 in the illustrated embodiment. The rows 900 of the second bottom end section portion 5124 and the second top end section portion 5114 cross at an angle.

The concavity forming portion 5116 forms the side surfaces 352 of the vent with concavities 2800 or indentations. In the illustrated embodiment, the filter 2000 completely covers the top surface 350, completely covers the side surfaces 352, and extends inward on the bottom surface 354 of the vent. However, indentations 2800 space the filter material 2000 apart from the side surfaces 352. This spacing improves the net free vent area of the vent, since the filter material is not pressed up against the side surfaces 352 and allows the filter 2000 to be tightly wrapped around the vent.

In one exemplary embodiment, the first top end section portion 5110, the substantially flat dense portion 5112, the second top end section portion 5114, the concavity forming portion 5116, the first bottom end section portion 5120, the support portion 5122, the second bottom end section portion 5124 are configured such that when the vent is folded to the configuration illustrated by FIG. 53, the side surfaces 352 are tapered (See FIGS. 37-40). In another exemplary embodiment, the first top end section portion 5110, the substantially flat dense portion 5112, the second top end section portion 5114, the concavity forming portion 5116, the first bottom end section portion 5120, the support portion 5122, the second bottom end section portion 5124 are configured such that when the vent is folded to the configuration illustrated by FIG. 52, the side surfaces 352 are vertical.

FIGS. 37-40 illustrate exemplary embodiments of vents 300 that are similar to the vents 300 illustrated by FIG. 20A (without the filter 2000), FIG. 3, FIG. 20A (with the filter 2000), and FIG. 20B respectively. The vents 37-40 each have side edges 352 that are tapered, instead of being vertical. The tapered edges provide a sharp, aesthetically pleasing appearance. The tapered edges have a greater area than vents of the same height that have vertical edges. This greater area is because the distance from edge 3700 to edge 3702 (See FIG. 37) is greater than the distance from edge 2050 to edge 2052 (See FIG. 20A). This greater area increases the net free vent area of the vent 300. The tapered edge configuration reduces the direct exposure of the vent edge 352 to the sun and UV rays. The shingle 18 (See FIG. 1) that overlies the edge 3700 acts as a sort of awning over the inwardly tapered vent edge 352, protecting the vent edge from UV rays. Reducing the direct UV exposure of the edge 352 prolongs the life of the convoluted filaments 304 that form the vent.

FIGS. 41-44 illustrate exemplary embodiments of vents 300 that are similar to the vents 300 illustrated by FIG. 20A (without a filter 2000), FIG. 3, FIG. 20A (with a filter 2000 on the bottom), and FIG. 20B respectively. The vents 41-44 each have nailing channels 4100. The nailing channels 4100 allow the vent 300 to be nailed to the roof before the shingle 18 is nailed to the roof. This allows the vent 300 to be positioned or "tacked" in place before the shingles are installed over the vent 300. In an exemplary embodiment, the nailing channel 4100 includes a reinforcement material 4102. The nailing channel 4100 and the reinforcement material 4102 work with nails applied by a nail gun to minimize the impact on the entangled net 302. The nailing channel 4100 and the reinforcement material 4102 maintain the integrity of the full entangled net 302 to resist pull-through at the nail head.

The reinforcement material 4102 can take a wide variety of different forms. For example, the reinforcement material may comprise more densely applied convoluted filaments or a separately applied reinforcement material. Examples of separately applied reinforcement materials include, but are not limited to fabrics, which are woven or non-woven, and tapes. Materials that the fabrics or tapes may be made from include, but are not limited to polyester fiber, nylon, KEVLAR®, cotton, rayon, and fiberglass. polypropylene It will be understood that the embodiments of the woven reinforcement material described herein may have any desired weave pattern. It will be understood that the reinforcement material 4102 may be formed as a non-woven mat. In a first embodiment of a non-woven mat, the non-woven mat may comprise about 10 percent glass fiber and about 90 percent bi-component polymer fiber, or a glass to bi-component fiber ratio of 10:90. One example of a suitable bi-component fiber is a fiber having a polyethylene (PE) outer sheath and a polyethylene terephthalate (PET) core, wherein the bi-component fibers have a 50:50 by weight sheath to core ratio. It has been shown that the glass fiber in the reinforcement material helps to ensure dimensional stability of the reinforcement material when it is cured and when it is applied to a shingle. The reinforcement material can take any of the forms and can be made from any of the materials described by U.S. Pat. No. 8,430,983, which is incorporated herein by reference in its entirety.

FIGS. 45-47 illustrate exemplary embodiments of vents 300 that are similar to the vents 300 illustrated by FIGS. 41-44. The vent 300 has the web 302 configuration of the vent illustrated by FIG. 32. The nailing channels 4100 of the FIG. 41-44 embodiments are omitted in the FIG. 45-47 embodiments. The reinforcement material 4102 is on an upper surface 350 of the vent 300. The reinforcement material can take any of the forms described with respect to the embodiments illustrated by FIGS. 41-44.

In one exemplary embodiment, composite structures of the vent 300 are formed when the molten filaments 5 (See FIG. 2A) are applied to the filter 2000. The molten filaments 5 melt the filter material 2000 and form a composite structure. One such composite structure may form the reinforcement material 4102. In one exemplary embodiment, portions of the filter material are intentionally contacted with the molten filaments 5 to keep the filter material 2000 in its original configuration with its original porosity. In an exemplary embodiment, one area where filter material is not contacted is at the side surfaces 352 of the vent. The side surfaces 352 and the filter material 2000 over the side surfaces may act as the exhaust (or inlet, depending on the application) of the vent. By not contacting the filter material at the side edge 352 with the molten filaments, the net free vent area of the vent 300 may be maximized.

FIGS. 48-50 illustrate exemplary embodiments of vents 300 that include a hinge 4800. The hinge 4800 can be included in any vent configuration, including, but not limited to any of the vent configurations described by the present application. The hinge 4800 allows the vent 300 to bend more sharply at the roof ridge. In the illustrated embodiment, the hinge 4800 is positioned in the center of the vent 300. The hinge 4800 an take a wide variety of different forms. Any net 302 configuration that allows the center of the vent 300 to bend more easily can be employed. FIGS. 48-50 illustrate three of the many different possible configurations for the hinge 4800. In the example illustrated by FIG. 48, the hinge 4800 comprises a sharp notch 4802. In the example illustrated by FIG. 49, the hinge 4800 comprises a smooth, round indentation 4902. In the example illustrated by FIG. 50, the hinge 4800 comprises a sharp notch 4802 and a smooth, round indentation 4902. In an exemplary embodiment, the hinge 4800 is formed in the entangled net by the tool as the convoluted filaments 304 are strewn onto the tool. In another embodiment, the vent 300 may be formed first and the hinge 4800 is added later. For example, the hinge 4800 may be cut into the vent and/or formed by applying heat and compressing the vent at the center of the vent. Any way of forming the hinge 4800 can be implemented.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to any particular rook or roof vent. Thus, for example, use of the inventive concepts to all types of roofs and roof vents, are within the spirit and scope of the general inventive concepts. As another example, although the embodiments disclosed herein have been primarily directed to a roof ridge vent, the general inventive concepts could be readily extended to any application which could benefit from the entangled net and/or filter configurations disclosed herein. It is sought, therefore, to cover all such changes and modifications as fall within the spirit and scope of the general inventive concepts, as described and claimed herein, and equivalents thereof.

Several exemplary embodiments of vents are disclosed by this application. US Patent Application Publication Pub. No.: 2013/0178147 is incorporated herein by reference in its entirety. Vents in accordance with the present invention may include any combination or subcombination of the features disclosed by the present application and by US Patent Application Publication Pub. No. 2013/0178147.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Still further, while specifically shaped features have been shown and described herein, other geometries can be used including elliptical, polygonal (e.g., square, rectangular, triangular, hexagonal, etc.) and other shapes can also be used. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A roof vent comprising:

a center section made from a layer of convoluted filaments;

a first end section extending from the center section, wherein the first end section comprises a top layer made from convoluted filaments and a bottom layer made from convoluted filaments; and a second end section extending from the center section, wherein the second end section comprises a top layer made from convoluted filaments and a bottom layer made from convoluted filaments;

wherein a thickness of the first end section is substantially the same as a thickness of the layer of convoluted filaments of the center section;

wherein a thickness of the second end section is substantially the same as a thickness of the layer of convoluted filaments of the center section; and wherein the top layer of the first end section comprises undulating rows with peaks and valleys and the bottom layer of the first end section comprises undulating rows with peaks and valleys and the top layer of the second end section comprises undulating rows with peaks and valleys and the bottom layer of the second end section comprises undulating rows with peaks and valleys.

2. The roof vent of claim 1, wherein a thickness of the top layer of the first end section is one-half the thickness of the layer of convoluted filaments of the center section, a thickness of the bottom layer of the first end section is one-half the thickness of the layer of convoluted filaments of the center section, a thickness of the top layer of the second end section is one-half the thickness of the layer of convoluted filaments of the center section, and a thickness of the bottom layer of the second end section is one-half the thickness of the layer of convoluted filaments of the center section.

3. The roof vent of claim 1, wherein a density of filaments of the first end section is greater than a density of filaments of the layer of convoluted filaments of the center section and a density of filaments of the second end section is greater than the density of filaments of the layer of convoluted filaments of the center section.

4. The roof vent of claim 1, wherein the density of filaments of the first end section is twice the density of filaments of the layer of convoluted filaments of the center section and the density of filaments of the second end section is twice the density of filaments of the layer of convoluted filaments of the center section.

5. The roof vent of claim 1, wherein the roof vent has a length, wherein the undulating rows of peaks and valleys of the top layers extend at a first angle with respect to the length of the roof vent, and the undulating rows of peaks and valleys of the bottom layers extend at a second angle with respect to the length of the roof vent to form a crossing pattern with the undulating rows of peaks and valleys of the top layers.

6. The roof vent of claim 5 wherein said first angle is forty-five degrees.

7. The roof vent of claim 1, wherein the bottom layer of the first end section is folded under the top layer of the first end section and the top bottom layer of the second end section is folded under the top layer of the second end section.

8. The roof vent of claim 1, wherein the layer of convoluted filaments of the center section comprises upwardly extending, first spacing elements.

9. The roof vent of claim 1, wherein a portion of the top layer of the first end section is substantially flat and a portion of the top layer of the second end section is substantially flat.

10. The roof vent of claim 9 wherein the substantially flat portion of the first end section is configured to catch the head of a standard roofing nail applied by a standard roofing nail gun.

11. The roof vent of claim 1, wherein the undulating rows of the top layer of the first end section engage the undulating rows of the bottom layer of the first section.

12. A roof vent comprising:

a center section made from a layer of convoluted filaments;

a first end section extending from the center section, wherein the first end section comprises a top layer made from convoluted filaments and a bottom layer made from convoluted filaments; and a second end section extending from the center section, wherein the second end section comprises a top layer made from convoluted filaments and a bottom layer made from convoluted filaments;

wherein a thickness of the first end section is substantially the same as a thickness of the layer of convoluted filaments of the center section;

wherein a thickness of the second end section is substantially the same as a thickness of the layer of convoluted filaments of the center section;

wherein the layer of convoluted filaments of the center section comprises upwardly extending, first spacing elements; and wherein the convoluted filaments of the bottom layer of the first end section comprises upwardly extending second spacing elements, and wherein the first spacing elements have a first height and the second spacing elements have a second height that is less than the first height.

13. The roof vent of claim 12, wherein the convoluted filaments of the top layer of the first end section comprises downwardly extending third spacing elements.

14. The roof vent of claim 13, wherein the third spacing elements have a third height that is less than the first height.

15. The roof vent of claim 12, wherein the top layer of the first end section comprises undulating rows with peaks and valleys.

16. The roof vent of claim 15, wherein the second spacing elements engage the undulating rows with peaks and valleys.

17. A roof comprising:

sloping roof planes that intersect at a roof peak, wherein a slot is provided at the roof peak;

a vent disposed over the slot in the roof peak, wherein the vent comprises:

a center section made from a layer of convoluted filaments;

a first end section extending from the center section, wherein the first end section comprises a top layer made from convoluted filaments and a bottom layer made from convoluted filaments; and a second end section extending from the center section, wherein the second end section comprises a top layer made from convoluted filaments and a bottom layer made from convoluted filaments;

wherein a thickness of the first end section is substantially the same as a thickness of the layer of convoluted filaments of the center section;

wherein a thickness of the second end section is substantially the same as the thickness of the layer of convoluted filaments of the center section; and wherein the top layer of the first end section comprises undulating rows with peaks and valleys and the bottom layer of the first end section comprises undulating rows with peaks and valleys and the top layer of the second end section comprises undulating rows with peaks and valleys and the bottom layer of the second end section comprises undulating rows with peaks and valleys.

18. The roof of claim 17, wherein a thickness of the top layer of the first end section is one-half the thickness of the layer of convoluted filaments of the center section, a thickness of the bottom layer of the first end section is one-half the thickness of the layer of convoluted filaments of the center section, a thickness of the top layer of the second end section is one-half the thickness of the layer of convoluted filaments of the center section, and a thickness of the bottom layer of the second end section is one-half the thickness of the layer of convoluted filaments of the center section.

19. The roof of claim 17, wherein a density of filaments of the first end section is greater than a density of filaments of the layer of convoluted filaments of the center section and a density of filaments of the second end section is greater than the density of filaments of the layer of convoluted filaments of the center section.

20. The roof of claim 18, wherein the undulating rows of the top layer of the first end section engage the undulating rows of the bottom layer of the first section.

* * * * *